US009534278B2

(12) United States Patent
Ueda et al.

(10) Patent No.: US 9,534,278 B2
(45) Date of Patent: Jan. 3, 2017

(54) RAIL

(71) Applicant: NIPPON STEEL & SUMITOMO METAL CORPORATION, Tokyo (JP)

(72) Inventors: Masaharu Ueda, Tokyo (JP); Teruhisa Miyazaki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 28 days.

(21) Appl. No.: 14/406,300

(22) PCT Filed: Jun. 13, 2013

(86) PCT No.: PCT/JP2013/066335

§ 371 (c)(1),
(2) Date: Dec. 8, 2014

(87) PCT Pub. No.: WO2013/187470

PCT Pub. Date: Dec. 19, 2013

(65) Prior Publication Data

US 2015/0136864 A1 May 21, 2015

(30) Foreign Application Priority Data

Jun. 14, 2012 (JP) ..... 2012-134442

(51) Int. Cl.
*C22C 38/24* (2006.01)
*C21D 9/04* (2006.01)
(Continued)

(52) U.S. Cl.
CPC ..... *C22C 38/24* (2013.01); *C21D 9/04* (2013.01); *C22C 38/001* (2013.01);
(Continued)

(58) Field of Classification Search
CPC ..... E01B 5/00; E01B 5/02; E01B 5/08; E01B 5/10; C21C 7/00; C21C 7/0025
(Continued)

(56) References Cited

U.S. PATENT DOCUMENTS

2011/0155821 A1* 6/2011 Ueda ..... C21C 7/0025 238/150
2011/0303756 A1 12/2011 Ueda et al.
2013/0065079 A1 3/2013 Ueda et al.

FOREIGN PATENT DOCUMENTS

JP 63-23244 B2 5/1988
JP 8-49019 A 2/1996
(Continued)

OTHER PUBLICATIONS

Japanese Office Action, dated Dec. 9, 2014, for Japanese Application No. 2014-029930, including a partial English translation.
(Continued)

*Primary Examiner* — R. J. McCarry, Jr.
(74) *Attorney, Agent, or Firm* — Birch, Stewart, Kolasch & Birch, LLP

(57) ABSTRACT

A rail is provided in which in a range from a surface of a head of the rail to a depth of 30 mm, 95% or more of a structure is composed of a pearlite structure by area %, and in a range with a depth of 20 mm to 30 mm from the surface of the head of the rail, an average grain size of a pearlite block in a transverse section is 120 μm to 200 μm.

4 Claims, 7 Drawing Sheets

(51) Int. Cl.

| | |
|---|---|
| ***C22C 38/04*** | (2006.01) |
| ***C22C 38/02*** | (2006.01) |
| ***C22C 38/12*** | (2006.01) |
| ***C22C 38/14*** | (2006.01) |
| ***C22C 38/18*** | (2006.01) |
| ***C22C 38/26*** | (2006.01) |
| ***C22C 38/00*** | (2006.01) |
| ***C22C 38/06*** | (2006.01) |
| ***C22C 38/08*** | (2006.01) |
| ***C22C 38/10*** | (2006.01) |
| ***C22C 38/16*** | (2006.01) |
| ***E01B 5/02*** | (2006.01) |

(52) U.S. Cl.
CPC ..... *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/18* (2013.01); *C22C 38/26* (2013.01); *E01B 5/02* (2013.01); *C21D 2211/009* (2013.01)

(58) Field of Classification Search
USPC ..... 238/122, 125, 126, 130, 148–150
See application file for complete search history.

(56) References Cited

FOREIGN PATENT DOCUMENTS

| | | | |
|---|---|---|---|
| JP | 8-109439 | A | 4/1996 |
| JP | 8-144016 | A | 6/1996 |
| JP | 8-246100 | A | 9/1996 |
| JP | 9-111352 | A | 4/1997 |
| JP | 3445619 | B2 | 9/2003 |
| JP | 2003-293086 | A | 10/2003 |
| JP | 2004-43865 | A | 2/2004 |
| JP | 3513427 | B2 | 3/2004 |
| WO | 2010/095354 | A1 | 8/2010 |
| WO | 2011/155481 | A1 | 12/2011 |

OTHER PUBLICATIONS

International Search Report, mailed Aug. 27, 2013, issued in PCT/JP2013/066335.
Written Opinion of the International Searching Authority, mailed Aug. 27, 2013, issued in PCT/JP2013/066335.

* cited by examiner

RAIL

TECHNICAL FIELD OF THE INVENTION

The present invention relates to a high-strength rail which is used in a cargo railway and in which internal fatigue damage resistance is improved.

Priority is claimed on Japanese Patent Application No. 2012-134442, filed on Jun. 14, 2012, the content of which is incorporated herein by reference.

RELATED ART

Along with economic development, new development of natural resources such as coal has been in progress. Specifically, mining in a region in a severely harsh natural environment, which has not yet been developed until now, has been in progress. According to this, in a freight railway that transports the resources, a track environment has been severe. Wear resistance that is equal to or higher than current wear resistance has been demanded for the rail. In consideration of this situation, development of a rail having improved wear resistance has been in demand.

To improve the wear resistance of rail steel, the following high-strength rail has been developed. As a main characteristic of the rail, a pearlite lamellar spacing is made fine through a heat treatment to increase the hardness of the steel so as to improve the wear resistance. As another characteristic, an amount of carbon in the steel is increased to increase a volume ratio of cementite phase in pearlite lamella (for example, refer to Patent Document 1 and Patent Document 2).

In the technology disclosed in Patent Document 1, after completion of hot rolling of a rail, or after re-heating of the rail, a head of a rail is subjected to accelerated cooling from an austenite temperature range of 850° C. to 500° C. at a cooling rate of 1° C./sec to 4° C./sec, thereby providing a rail having excellent wear resistance.

In the technology disclosed in Patent Document 2, a volume ratio of cementite included in a lamella in a pearlite structure is increased by using hypereutectoid steel (C: more than 0.85% to 1.20%), thereby providing a rail having excellent wear resistance.

In the technologies disclosed in Patent Document 1 and Patent Document 2, an improvement in the wear resistance of the rail is realized by an increase in hardness of the rail due to refinement of the lamellar spacing in the pearlite structure, and by an increase in a volume ratio of cementite phase included in the lamella in the pearlite structure. However, in the freight railway, fatigue damage from the inside of the head of the rail (in a range with a depth of 20 mm to 30 mm from a surface of the head of the rail) has occurred frequently.

Accordingly, development of a high-strength rail having improved internal fatigue damage resistance has been demanded. To solve the problem related to fatigue damage, the following high-strength rail has been developed. As a main characteristic of the rail, to improve internal fatigue damage resistance, a slight amount of alloy is contained in steel, thereby controlling a pearlite transformation. In addition, as another characteristic of the rail, a slight amount of alloy is allowed to precipitate in a pearlite structure of steel, thereby improving hardness inside the head of the rail (for example, refer to Patent Document 3 and Patent Document 4).

In the technology disclosed in Patent Document 3, B is contained in hypereutectoid steel (C: more than 0.85% to 1.20%) to control a pearlite transformation temperature inside the head of the rail, thereby improving hardness inside the head of the rail.

In the technology disclosed in Patent Document 4, V and N are contained in hypereutectoid steel (C: more than 0.85% to 1.20%) to allow carbonitrides of V in a pearlite structure to precipitate, thereby improving hardness inside the head of the rail.

In the technologies disclosed in Patent Document 3 and Patent Document 4, the hardness inside the head of the rail is improved by controlling the pearlite transformation temperature inside the head of the rail or precipitation strengthening of the pearlite structure, whereby realizing the improvement of the internal fatigue damage resistance in an arbitrary constant range. However, internal fatigue damage may occur due to a variation in manufacturing conditions, and the like, and thus the internal fatigue damage resistance may deteriorate.

PRIOR ART DOCUMENT

Patent Document

[Patent Document 1] Japanese Patent No. 1567914

[Patent Document 2] Japanese Unexamined Patent Application, First Publication No. H08-144016

[Patent Document 3] Japanese Unexamined Patent Application, First Publication No. H08-527465

[Patent Document 4] Japanese Patent No. 3513427

[Patent Document 5] Japanese Unexamined Patent Application, First Publication No. H08-246100

[Patent Document 6] Japanese Unexamined Patent Application, First Publication No. H09-111352

DISCLOSURE OF THE INVENTION

Problems to be Solved by the Invention

The present invention has been made in consideration of the above-described problems, and an object thereof is to provide a rail having improved internal fatigue damage resistance that is demanded in a rail of a freight railway.

Means for Solving the Problem

Hereinafter, various aspects of the invention will be described.

(1) According to an aspect of the invention, a rail is provided having a chemical composition including, by mass %, C: 0.75% to 1.20%, Si: 0.10% to 2.00%, Mn: 0.10% to 2.00%, P: 0.0250% or less, S: 0.0250% or less, Cr: 0% to 2.00%, Mo: 0% to 0.50%, Co: 0% to 1.00%, B: 0% to 0.0050%, Cu: 0% to 1.00%, Ni: 0% to 1.00%, V: 0% to 0.50%, Nb: 0% to 0.050%, Ti: 0% to 0.0500%, Mg: 0% to 0.0200%, Ca: 0% to 0.0200%, REM: 0% to 0.0500%, Zr: 0% to 0.0200%, N: 0% to 0.0200%, and Al: 0% to 1.00%, the remainder being Fe and impurities. The rail includes a top head which is a flat region extending along a longitudinal direction of the rail and is located at a top of a head of the rail, a side head which is a flat region extending along the longitudinal direction of the rail and is located at a side of the head of the rail, a corner head which is a region including a rounded corner extending between the top head and the side head along the longitudinal direction of the rail, and an upper half of the side head, and a surface of the top head of the rail which is a region including a surface of the top head and a surface of the corner head. In a range from the surface of the head of the rail to a depth of 30 mm, 95% or more of a structure is composed of a pearlite structure by area %. In a range with a depth of 20 mm to 30 mm from a surface of the head of the rail, an average grain size of a pearlite block in a transverse section is 120 μm to 200 μm.

(2) In the rail according to (1), in a range with a depth of 20 mm to 30 mm from a surface of the head of the rail, average hardness may be Hv 350 to Hv 460.

(3) In the rail according to (1) or (2), the chemical composition may further include, by mass %, one or more kinds of Cr: 0.01% to 2.00%, Mo: 0.01% to 0.50%, Co: 0.01% to 1.00%, B: 0.0001% to 0.0050%, Cu: 0.01% to 1.00%, Ni: 0.01% to 1.00%, V: 0.005% to 0.50%, Nb: 0.0010% to 0.050%, Ti: 0.0030% to 0.0500%, Mg: 0.0005% to 0.0200%, Ca: 0.0005% to 0.0200%, REM: 0.0005% to 0.0500%, Zr: 0.0001% to 0.0200%, N: 0.0060% to 0.0200%, and Al: 0.0100% to 1.00%.

Effects of the Invention

According to the aspect of the invention, chemical components and a structure of rail steel are controlled to control an average grain size of a pearlite block and average hardness inside a head of a rail. According to this, internal fatigue damage resistance of a rail that is used in a freight railway is improved, and thus it is possible to greatly improve the service life of the rail.

EMBODIMENTS OF THE INVENTION

Figure 1:
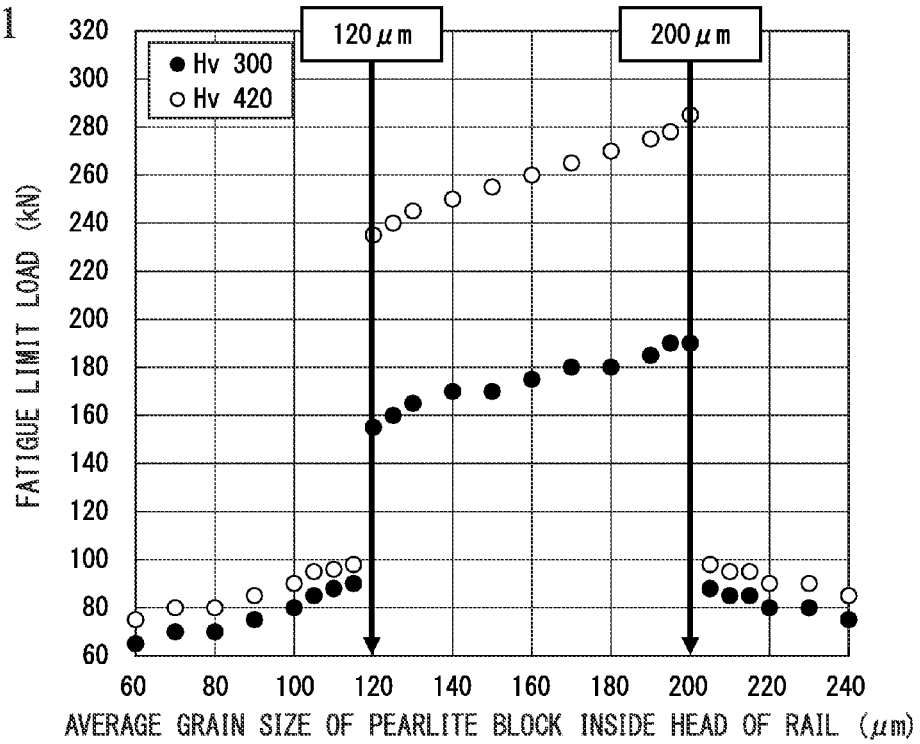
FIG. 1 is a view showing a relationship between an average grain size of a pearlite block inside a head of a rail and a fatigue limit load.

Hereinafter, an embodiment of the invention will be described in detail with reference to the attached drawings. However, it should be understood by those skilled in the art that the invention is not limited to the following description and various changes or modifications may be made without departing from the gist and scope of the invention. Accordingly, the invention is not limited to the following description.

In the embodiment, a rail that has excellent internal fatigue damage resistance will be described in detail. Hereinafter, mass % in a composition is described as "%".

First, the present inventors have examined the starting point of internal fatigue damage to improve the internal fatigue damage resistance of a rail. As a result, the present inventors have found that the damage occurs from a pearlite structure. After carrying out more detailed examination, the present inventors have found that a slip band is generated at a boundary of pearlite block (pearlite block boundary) in the pearlite structure, and a fatigue crack is generated from the slip band.

Accordingly, the present inventors have considered that the internal fatigue damage resistance can be controlled by controlling an area of the pearlite block boundary at which the slip band is generated. In addition, as a method of controlling the area of the pearlite block boundary, a controlling a grain size of the pearlite block has been examined. As an average grain size of the pearlite block decreases, the area of the pearlite block boundary increases.

To make clear a relationship between the area of the pearlite block boundary and the internal fatigue damage, the present inventors have prepared various rails in which an average grain size of the pearlite block inside a head of the rail is different in each case, and have examined a rolling contact fatigue property of the rails. The rails have been prepared by performing hot rolling and a heat treatment with respect to steel in which an amount of carbon is 0.90% (0.90% C-0.50% Si-0.90% Mn-0.0150% P-0.0120% S) under various conditions. During manufacturing of the rails, an average grain size of the pearlite block in a range with a depth of 20 mm to 30 mm from a surface of the head of the rail is controlled to 20 μm to 320 μM, and average hardness of the pearlite structure is controlled to Hv 300 or Hv 420.

The rolling contact fatigue property is measured by repetitively bringing an actual wheel into rolling contact with an actual head of the rail (rolling contact fatigue test). Details of the test conditions are as follows.

<Method of Evaluating Rolling Contact Fatigue Property>

Test Conditions

Test machine: Rolling contact fatigue test machine (refer to FIG. 5)

Shape of Test specimen; Rail: 136 pound rail (length: 2 m)/Wheel: Association of American Railroads (AAR) type (diameter: 920 mm)

Load; Radial: 50 kN to 300 kN/Thrust: 20 kN

Lubrication: Dry+Oil (intermittent oiling)

Number of repeating times of rolling: 2,000,000 times to the maximum

Evaluation

Fatigue limit load: the maximum value of a vertical load, in which the internal fatigue damage does not occur when rolling contact is repeated for 2,000,000 times, is obtained.

FIG. 1 shows a relationship between the average grain size of the pearlite block inside the head of the rail (in a range with a depth of 20 mm to 30 mm from a surface of the head of the rail) and the fatigue limit load. A strong correlation has been found between the average grain size of the pearlite block and the fatigue limit load. In a case where the average grain size of the pearlite block is in a range of 120 to 200 μm, the fatigue limit load stably exceeds 150 kN, and thus the internal fatigue damage resistance of the rails is greatly improved. On the other hand, when the average grain size of the pearlite block is less than 120 μm, the fatigue limit load decreases to 100 kN or less. In addition, in a case where the average grain size of the pearlite block exceeds 200 μm, the fatigue limit load decreases to 100 kN or less. From these results, the present inventors have confirmed that an optimal range regarding the area of the pearlite block boundary in the pearlite structure for improving the internal fatigue damage resistance is present, that is, an optimal range regarding the average grain size of the pearlite block is present.

In addition, the present inventors have made clear the reason why the optimal range is present in the average grain size of the pearlite block. According to fractography of the internal fatigue damage portion, the present inventors have confirmed that in a rail in which the fatigue limit load decreases and the average grain size of the pearlite block is less than 120 μm, a plurality of small fatigue cracks are generated from the pearlite block boundary as anticipated, and one of the small fatigue cracks selectively propagates and forms the internal fatigue damage. In addition, it has been clear that in a rail in which the fatigue limit load decreases and the average grain size of the pearlite block exceeds 200 μm, the generation of the fatigue crack is less, but a brittle crack is generated from the tip end of the fatigue crack that selectively propagates, and the internal fatigue damage occurs due to brittle fracture caused by the brittle crack.

From the results, for the improvement of the internal fatigue damage resistance, the present inventors have found that it is necessary to control an area of the pearlite block boundary inside the head of the rail, that is, the average grain size of the pearlite block to an optimal range, thereby suppressing propagation of the fatigue crack and the brittle fracture.

In addition, the present inventors examined a method of further improving internal fatigue damage resistance, and considered that in addition to controlling the grain size of the block in the pearlite structure inside the head of the rail, when the hardness of the pearlite structure is controlled to strengthen the pearlite block boundary in which the slip band is generated, internal fatigue damage resistance of the rail is improved.

The present inventors prepared various rails in which the average size of the pearlite block inside the head of the rail and the hardness are different in each case through hot rolling and the subsequent heat treatment (accelerated cooling) under various conditions by using steel in which an amount of C is 0.90% (0.90% C-0.50% Si-0.90% Mn-0.0150% P-0.0120% S), and they have examined the rolling contact fatigue property of the rails. During manufacturing of each of the rails, the average grain size of the pearlite block in a range with a depth of 20 mm to 30 mm from a surface of the head of the rail is controlled to 120 μm, 160 μm, and 200 μm, and the average hardness of the pearlite structure is controlled to Hv 300 to Hv 500. The rolling contact fatigue property is evaluated by the following method.

Figure 2:
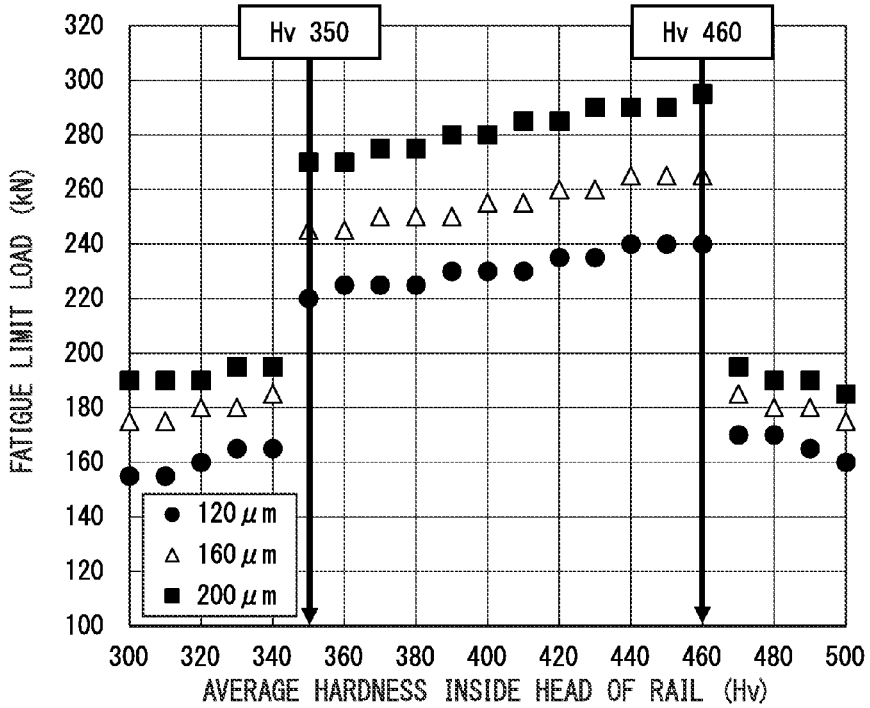
FIG. 2 is a view showing a relationship between hardness inside the head of the rail and the fatigue limit load.

FIG. 2 shows the relationship between the hardness inside the head of the rail (average hardness in a range with a depth of 20 mm to 30 mm from a surface of the head of the rail) and the fatigue limit load. Even in a rail having any average grain size of the pearlite block, the hardness inside the head of the rail and the fatigue limit stress have a strong correlation to each other. When the hardness inside the head of the rail becomes Hv 350 or more, the pearlite block boundary is strengthened and thus the fatigue limit load stably exceeds 200 kN. Accordingly, the internal fatigue damage resistance of the rail is greatly improved. However, even in a rail having any average grain size of the pearlite block, when the hardness inside the head of the rail exceeds Hv 460, the fatigue limit load is conversely less than 200 kN due to embrittlement of the pearlite structure. Therefore, it becomes apparent that the improvement of the internal fatigue damage resistance is not recognized.

From the results, the present inventors have confirmed that with respect to the hardness inside the head of the rail, an optimal range for further improving the internal fatigue damage resistance of the rail is present. That is, it is more preferable that the average hardness in a range with a depth of 20 mm to 30 mm from a surface of the head of the rail be Hv 350 to Hv 460.

That is, in a rail according to an aspect of the invention, chemical components and a structure of rail steel are controlled to control the average grain size of the pearlite block inside the head of the rail. According to this, the internal fatigue damage resistance of the rail is improved, and thus it is possible to greatly improve the service life of the rail. In addition, in a rail according to another aspect of the invention, the average hardness inside the head of the rail is controlled, and thus it is possible to further improve the internal fatigue damage resistance of the rail.

Next, the reason for limitation in an aspect of the invention will be described in detail. Hereinafter, mass % in a steel composition is simply described as "%".

(1) Reason for Limitation in Chemical Component of Steel

In a rail according to an aspect of the invention, the reason for limiting the chemical components of the steel to the above-described numerical ranges will be described in detail.

C is an element which promotes a pearlite transformation and which is effective to secure wear resistance. When an amount of C is less than 0.75%, it is difficult for this component system to maintain necessary minimum strength and wear resistance which are demanded for a rail. In addition, when the amount of C is less than 0.75%, a soft pro-eutectoid ferrite structure which tends to generate a fatigue crack is generated inside the head of the rail, and thus the internal fatigue damage tends to occur. In addition, when the amount of C exceeds 1.20%, a pro-eutectoid cementite structure tends to be generated inside the head of the rail. In this case, the fatigue crack is generated from an interface between the pro-eutectoid cementite structure and a pearlite structure, and thus the internal fatigue damage tends to occur. Therefore, the amount of C is limited to 0.75% to 1.20%. In addition, it is preferable that the amount of C be set to 0.85% to 1.10% so as to stabilize the generation of the pearlite structure, thereby further improving the internal fatigue damage resistance.

Si is an element that forms a solid solution in ferrite in the pearlite structure, and increases the hardness (strength) of the head of rail, thereby improving the wear resistance of the rail. In addition, Si is an element which suppresses generation of the pro-eutectoid cementite structure which causes generation of the fatigue crack, thereby suppressing occurrence of the internal fatigue damage. However, when an amount of Si is less than 0.10%, it is difficult to sufficiently attain this effect. In addition, when the amount of Si exceeds 2.00%, a lot of surface scratches are generated during hot rolling. In addition, when the amount of Si exceeds 2.00%, hardenability significantly increases, and thus a low-toughness martensite structure is generated inside the head of the rail. The wear resistance of the rail decreases due to the martensite structure, and thus the internal fatigue damage tends to occur. Therefore, the amount of Si is limited to 0.10% to 2.00%. In addition, it is preferable that the amount of Si be set to 0.20% to 1.50% so as to stabilize generation of the pearlite structure, thereby further improving the internal fatigue damage resistance.

Mn is an element which increases hardenability of steel and stabilizes pearlite transformation, and makes a lamellar spacing of the pearlite structure fine, thereby securing hardness of the pearlite structure and further improving the internal fatigue damage resistance. However, when an amount of Mn is less than 0.10%, this effect is small. In addition, when the amount of Mn is less than 0.10%, a soft pro-eutectoid ferrite structure which tends to generate the fatigue crack is generated inside the head of the rail, and thus it is difficult to secure the internal fatigue damage resistance. In addition, as the amount of Mn exceeds 2.00%, hardenability of steel significantly increases, and thus a low-toughness martensite structure is generated in the head of the rail. The wear resistance of the rail decreases due to the generation of the martensite structure, and thus the internal fatigue damage tends to occur. Therefore, the amount of Mn is limited to 0.10% to 2.00%. In addition, it is preferable that the amount of Mn be set to 0.20% to 1.50% so as to stabilize generation of the pearlite structure, thereby further improving the internal fatigue damage resistance.

P is an impurity element in steel. It is possible to control an amount of P by refining in a converter. When an amount of P exceeds 0.0250%, the pearlite structure becomes brittle, and a brittle crack is generated from a tip end of the fatigue crack inside the head of the rail, and thus, the internal fatigue damage tends to occur. Therefore, the amount of P is limited to 0.0250% or less. In addition, it is not necessary to limit the lower limit of the amount of P, but it is considered that the lower limit of the amount of P during actual manufacturing becomes approximately 0.0100% in consideration of dephosphorization capability in a refining. It is preferable that the upper limit of the amount of P be set to 0.0150% to further suppress the internal fatigue damage.

S is an impurity element in steel. It is possible to control an amount of S by performing desulfurization in a hot metal ladle. When the amount of S exceeds 0.0250%, coarse MnS-based sulfides as inclusions tend to be generated. In this case, the fatigue crack is generated due to stress concentration to the periphery of the inclusions at the inside of the head of the rail, and thus the internal fatigue damage tends to occur. Therefore, the amount of S is limited to 0.0250% or less. In addition, the lower limit of the amount of S is not limited, but it is considered that the lower limit of the amount of S during actual manufacturing becomes approximately 0.0050% in consideration of desulfurization capability during a refining. It is preferable that the upper limit of the amount of S be set to 0.0150% to further suppress the internal fatigue damage.

In addition, a rail that is manufactured with the above-described composition may contain one or more kinds of Cr, Mo, Co, B, Cu, Ni, V, Nb, Ti, Mg, Ca, REM, Zr, N, and Al as necessary so as to realize an improvement in wear resistance due to an increase in hardness (strength) of the pearlite structure and an improvement in toughness, prevention of softening in a welded heat-affected zone, and control of a hardness distribution of a cross-section inside the head of the rail.

Cr and Mo increase an equilibrium temperature ef-pearlite and make the lamellar spacing of the pearlite structure fine, thereby improving hardness. Co makes a lamella structure of a wearing surface fine, thereby increasing hardness of the wearing surface. B reduces cooling rate dependency of a pearlite transformation temperature, thereby making a hardness distribution of the head of the rail uniform. Cu is an element that forms a solid solution in ferrite in the pearlite structure, thereby increasing hardness of steel. Ni improves toughness and hardness of the pearlite structure, and prevents softening of the heat-affected zone of the welded joint. V, Nb, and Ti generate carbides and/or nitrides during a hot rolling and the subsequent cooling, and improve the fatigue strength of the pearlite structure due to precipitation hardening. In addition, V, Nb, and Ti stably generate carbides and/or nitrides during re-heating, and prevent the softening in the heat-affected zone of the welded joint. Mg, Ca, and REM finely disperse the MnS-based sulfides as inclusions, thereby reducing the internal fatigue damage that occurs from the inclusions. Zr increases an equiaxial crystal ratio of a solidified structure to suppress formation of a segregation zone at the central portion of a bloom or slab, thereby suppressing generation of the pro-eutectoid cementite structure and the martensite structure. N is contained to mainly precipitate to an austenite grain boundary to promote a pearlite transformation. Al is contained to mainly deoxidize a steel.

Cr is an element which raises the equilibrium temperature. Cr makes the lamellar spacing of the pearlite structure fine due to an increase in a degree of super cooling and improves the hardness (strength) of the pearlite structure, thereby improving the internal fatigue damage resistance. However, when an amount of Cr is less than 0.01%, the effect is small, and the effect of improving the hardness of steel is not exhibited. In addition, when Cr is excessively included in an amount exceeding 2.00%, hardenability may significantly increase, and thus the low-toughness martensite structure may be generated in the head of the rail, and the wear resistance may decrease, and thus the internal fatigue damage may tend to occur. Therefore, the amount of Cr may be limited to 0.01% to 2.00%. To accomplish the above-described effect in a further reliable manner, the amount of Cr may be limited to 0.10% to 0.30%.

Similar to Cr, Mo is an element which raises the equilibrium temperature, makes the lamellar spacing of the pearlite structure refine due to an increase in a degree of super cooling, and improves the hardness (strength) of the pearlite structure, thereby improving the internal fatigue damage resistance. However, when the amount of Mo is less than 0.01%, the effect is small, and thus the effect of improving the hardness of steel cannot be attained. In addition, when Mo is contained in an amount exceeding 0.50%, a transformation rate may significantly decrease, a low-toughness martensite structure may be generated in the head of the rail, the wear resistance may be decrease, and thus the internal fatigue damage may tend to occur. Therefore, the amount of Mo may be limited to 0.01% to 0.50%. To more reliably accomplish the above-described effect, the amount of Mo may be limited to 0.01% to 0.10%.

Co is an element that forms a solid solution in ferrite in the pearlite structure and makes the fine lamella structure, which is formed due to contact with a wheel in a wearing surface of a head surface of the rail, thereby increasing hardness of a rolling contact surface and improving wear resistance. However, when an amount of Co is less than 0.01%, refinement of the lamella structure is not promoted, and thus the effect of improving the wear resistance is difficult to attain. In addition, when the amount of Co exceeds 1.00%, the above-described effect is saturated, and thus the refinement of the lamella structure in accordance with the amount of addition may not be realized. In addition, economic efficiency may decrease due to an increase in the cost of a contained alloy. Therefore, the amount of Co may be limited to 0.01% to 1.00%. To more reliably accomplish the above-described effect, the amount of Co may be limited to 0.05% to 0.15%.

B is an element which forms an iron borocarbide ($Fe_{23}(CB)_6$) at an austenite grain boundary, and has an effect of promoting pearlite transformation. According to this promotion effect, cooling rate dependency of the pearlite transformation temperature is reduced, and thus a hardness distribution from the surface of the head of the rail to the inside of the head of the rail is made more uniform, thereby improving the internal fatigue damage resistance. However, when an amount of B is less than 0.0001%, the effect is not sufficient, and thus an improvement in the hardness distribution of the head of the rail is not recognized. In addition, when the amount of B exceeds 0.0050%, a coarse iron borocarbide may be generated, and thus the internal fatigue damage may tend to occur due to stress concentration. Therefore, the amount of B may be limited to 0.0001% to 0.0050%. To more reliably accomplish the above-described effect, the amount of B may be limited to 0.0005% to 0.0030%.

Cu is an element that forms a solid solution in ferrite in the pearlite structure, improves the hardness (strength) of the steel due to solid-solution strengthening, and improves the internal fatigue damage resistance. However, when an amount of Cu is less than 0.01%, it is difficult to attain the effect. In addition, when the amount of Cu exceeds 1.00%, a martensite structure may be generated in the head of the rail due to a significant improvement in hardenability, and the wear resistance may decrease, and thus the internal fatigue damage may tend to occur. Therefore, the amount of Cu may be limited to 0.01% to 1.00%. To more reliably accomplish the above-described effect, the amount of Cu may be limited to 0.10% to 0.30%.

Ni is an element which improves toughness of the pearlite structure and improves the hardness (strength) of steel due to solid-solution strengthening, thereby improving the internal fatigue damage resistance. In addition, Ni is an element which causes precipitation of fine $Ni_3Ti$, which is an intermetallic compound, at the welded heat-affected zone, thereby suppressing softening of steel due to precipitation strengthening. In addition, Ni is an element which suppresses embrittlement of a grain boundary in Cu-included steel. However, when an amount of Ni is less than 0.01%, the effect significantly decreases. When the amount of Ni exceeds 1.00%, a low-toughness martensite structure may be generated in the head of the rail due to a significant improvement in hardenability, and the wear resistance may be decrease, and thus the internal fatigue damage may tend to occur. Therefore, the amount of Ni may be limited to 0.01% to 1.00%. To more reliably accomplish the above-described effect, the amount of Ni may be limited to 0.05% to 0.20%.

V is an element which increases the hardness (strength) of the pearlite structure due to precipitation hardening by a V carbide and/or V nitride which are generated during a cooling after hot-rolling, thereby improving the wear resistance and the internal fatigue damage resistance of the rail. In addition, V is effective for prevention of softening of the heat-affected zone of the welded joint since V generates the V carbide or the V nitride at a relatively high temperature range at the heat-affected zone of the welded joint reheated to a temperature range equal to or lower than the Ac1 point. However, when an amount of V is less than 0.005%, it is difficult to sufficiently attain the effect, and thus an improvement in the hardness (strength) of the pearlite structure is not recognized. In addition, when the amount of V exceeds 0.50%, precipitation hardening due to the V carbide and/or the V nitride may become excessive, and the pearlite structure may become brittle, and thus the internal fatigue damage resistance of the rail may decrease. Therefore, the amount of V may be limited to 0.005% to 0.50%. To more reliably accomplish the above-described effect, the amount of V may be limited to 0.02% to 0.05%.

Similar to V, Nb is an element which increases the hardness (strength) of the pearlite structure due to precipitation hardening by a Nb carbide and/or a Nb nitride which are generated during a cooling after hot-rolling, and improves the wear resistance and the internal fatigue damage resistance. In addition, Nb is effective for prevention of softening of the heat-affected zone of the welded joint, since Nb stably generates the Nb carbide or the Nb nitride from a low temperature range to a high temperature range at the heat-affected zone of the welded joint reheated to a temperature range equal to or lower than the Ac1 point. However, when an amount of Nb is less than 0.0010%, it is difficult to attain the effect, and thus an improvement in the hardness (strength) of the pearlite structure is not recognized. In addition, when the amount of Nb exceeds 0.050%, precipitation hardening by the Nb carbide and/or the Nb nitride may become excessive, and the pearlite structure may become brittle, and thus the internal fatigue damage resistance of the rail may decrease. Therefore, the amount of Nb may be limited to 0.0010% to 0.050%. To more reliably accomplish the above-described effect, the amount of Nb may be limited to 0.0010% to 0.0030%.

Ti is an element which increases the hardness (strength) of the pearlite structure due to precipitation hardening by a Ti carbide and/or a Ti nitride which are generated in a cooling after hot rolling, and improves the wear resistance or the internal fatigue damage resistance. In addition, since the Ti carbide and/or the Ti nitride, which precipitate when being reheated during welding, are not dissolved into a structure, Ti makes a structure of the heat-affected zone heated up to an austenite range fine, and thus Ti is an element that is effective for prevention of embrittlement of the welded joint. However, when an amount of Ti is less than 0.0030%, the effect is small. In addition, when the amount of Ti exceeds 0.0500%, a coarse Ti carbide and/or a coarse Ti nitride may be generated, and the internal fatigue damage tends to occur due to stress concentration. Therefore, the amount of Ti may be limited to 0.0030% to 0.0500%. To more reliably accomplish the above-described effect, the amount of Ti may be limited to 0.0030% to 0.0100%.

Mg is an element which bonds to S and forms a fine sulfide (MgS). MgS finely disperses MnS which is an inclusion causing the fatigue crack, and thus reduces stress concentration in the vicinity of the inclusion, thereby improving the internal fatigue damage resistance. However, when an amount of Mg is less than 0.0005%, the effect is weak. In addition, Mn is contained in an amount exceeding 0.0200%, a coarse oxide of Mg may be generated, and the internal fatigue damage may tend to occur due to stress concentration in the vicinity of the coarse oxide. Therefore, the amount of Mg may be limited to 0.0005% to 0.0200%. To more reliably accomplish the above-described effect, the amount of Mg may be limited to 0.0010% to 0.0030%.

Ca is an element which strongly bonds to S, and forms a sulfide such as CaS. CaS finely disperses MnS which is an inclusion causing the fatigue crack, and reduces stress concentration in the vicinity of the inclusion, thereby improving the internal fatigue damage resistance. However, when an amount of Ca is less than 0.0005%, the effect is weak. In addition, when Ca is contained in an amount exceeding 0.0200%, a coarse oxide of Ca may be generated, and the internal fatigue damage may tend to occur due to stress concentration in the vicinity of the coarse oxide. Therefore, the amount of Ca may be limited to 0.0005% to 0.0200%. To more reliably accomplish the above-described effect, the amount of Ca may be limited to 0.0010% to 0.0030%.

REM is a deoxidizing and desulfurizing element. When REM is contained, an oxysulfide ($REM_2O_2S$) of REM is generated, and the oxysulfide becomes a product nucleus of a Mn sulfide-based inclusion. The oxysulfide ($REM_2O_2S$) as the nucleus has a high melting point, and suppresses lengthen of the Mn sulfide-based inclusion after rolling. As a result, REM finely disperses MnS as an inclusion, and reduces stress concentration in the vicinity of the inclusion, thereby improving the internal fatigue damage resistance. However, when an amount of REM is less than 0.0005%, the effect is small, and is not sufficient as the product nucleus of the MnS-based sulfide. In addition, when the amount of REM exceeds 0.0500%, hard oxysulfide ($REM_2O_2S$) of REM may be generated, and thus the internal fatigue damage may tend to occur due to stress concentration. Therefore, the amount of REM may be limited to 0.0005% to 0.0500%. To more reliably accomplish the above-described effect, the amount of REM may be limited to 0.0005% to 0.0030%.

In addition, REM is a rare-earth metal such as Ce, La, Pr, and Nd. Amount of the above-described elements are intended to limit the total amount of all REMs that are contained. If the total amount is in the above-described range, even when the respective elements are contained alone or in a composite manner (in combination of two or more kinds thereof), the same effect is obtained.

Since a $ZrO_2$ inclusion and γ-Fe have an excellent lattice matching property with each other, Zr is an element which becomes a solidification nucleus of high-carbon steel in which γ-Fe is a solidified primary crystal, and thus, increases an equiaxial crystal ratio of a solidified structure. Zr increases the equiaxial crystal ratio of a solidified structure, and suppresses formation of a segregation zone at the central portion of a bloom or slab, thereby suppressing generation of a martensite structure and a pro-eutectoid cementite structure which are generated in the segregation zone of the rail. However, when an amount of Zr is less than 0.0001%, the number of $ZrO_2$-based inclusions is small, and thus a sufficient operation as a solidification nucleus is not exhibited. As a result, the martensite structure or the pro-eutectoid cementite structure may tend to be generated at the segregation zone, and thus an improvement in the internal fatigue damage resistance of the rail is difficult to attain. In addition, when the amount of Zr exceeds 0.0200%, a large amount of coarse Zr-based inclusions may be generated, and thus the internal fatigue damage may tend to occur due to stress concentration. Therefore, the amount of Zr is limited to 0.0001% to 0.0200%. To more reliably accomplish the above-described effect, the amount of Zr may be limited to 0.0010% to 0.0030%.

N is an element which promotes precipitation of a carbonitride of V during a cooling after hot-rolling in a case in which N is contained in combination with V. N increases the hardness (strength) of the pearlite structure due to the promotion of precipitation, thereby improving the wear resistance or the internal fatigue damage resistance. However, when an amount of N is less than 0.0060%, the effect is weak. In addition, when the amount of N exceeds 0.0200%, it may be difficult to allow N to form a solid solution in steel, and a bubble forms as the starting point of the fatigue damage may be generated, and thus the internal fatigue damage tends to occur. Therefore, the amount of N may be limited to 0.0060% to 0.0200%. To more reliably accomplish the above-described effect, the amount of N may be limited to 0.0080% to 0.0120%.

Al is an element which operates as a deoxidizing. In addition, Al is an element that raises an eutectoid transformation temperature, and this characteristic contributes to high hardness (strength) of the pearlite structure, thereby improving the wear resistance of the pearlite structure or the internal fatigue damage resistance. However, when an amount of Al is less than 0.0100%, the effect is weak. In addition, when the amount of Al exceeds 1.00%, it may be difficult to allow Al to form a solid solution in steel. Therefore, a coarse alumina-based inclusion may be generated, and the fatigue crack may be generated from the coarse precipitate, and thus the internal fatigue damage tends to occur. In addition, an oxide may be generated during welding, and thus weldability may significantly deteriorate. Therefore, an amount of Al may be limited to 0.0100% to 1.00%. To more reliably accomplish the above-described effect, the amount of Al may be limited to 0.0150% to 0.0300%.

The rail according to an aspect of this embodiment contains the above-described components, and the remainder includes iron and impurities. Examples of the impurities are included in a raw material such as an ore and scrap, and impurities that are included during manufacturing processes.

Steel having the above-described composition is melted with a typically used melting furnace such as a converter and an electric furnace and becomes molten steel. The molten steel is subjected to ingot-making and blooming, or is continuously casted, and then hot-rolling is performed to manufacture a rail. In addition, a heat treatment may be performed to control a structure of the head surface of the rail as necessary.

(2) Reason for Limiting Structure and Pearlite Structure

With regard to the rail according to the aspect of this embodiment, in a range from the surface of the head of the rail to a depth of 30 mm, the reason for setting 95% or more of a structure to the pearlite structure by area % will be described in detail.

First, the reason for limiting 95% or more of the structure to the pearlite structure will be described.

In the head of the rail which comes into contact with a wheel, securement of the wear resistance is the most important. The present inventors examined a relationship between the structure and the wear resistance, and as a result, it has been confirmed that the pearlite structure mostly increases the wear resistance of the head of the rail. In addition, according to an experiment, it has been confirmed that the improvement of the internal fatigue damage resistance is realized by controlling a grain size of a pearlite block. Accordingly, to improve and secure the wear resistance and the internal fatigue damage resistance, in a range from a surface of the head of the rail to a depth of 30 mm, 95% or more of the structure is composed of the pearlite structure. It is not necessary to define the upper limit of an amount of the pearlite structure, and the upper limit is 100%.

Next, the reason for limiting a necessary range of the pearlite structure to the range from the surface of the head of the rail to a depth of 30 mm will be described.

In a case where the range, in which 95% or more of the structure is composed of the pearlite structure, extends from the surface of the head of the rail to a depth of less than 30 mm, it is difficult to accomplish the wear resistance and the internal fatigue damage resistance, which are demanded for the head of the rail, and thus it is difficult to sufficiently improve the service life of the rail.

The upper limit of the depth in the range, in which 95% or more of the structure is composed of the pearlite structure, is not particularly limited. To further improve the internal fatigue damage resistance, it is preferable that 95% or more of the structure in a range from the surface of the head of the rail to a depth of approximately 40 mm be set to the pearlite structure.

Figure 3:
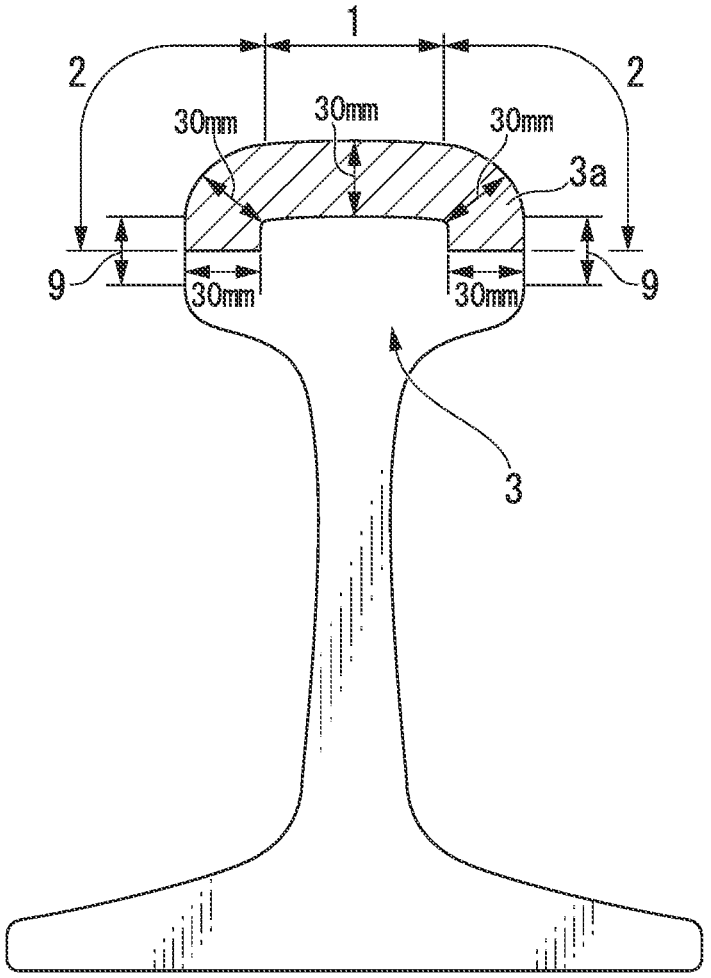
FIG. 3 is a view showing appellation at a surface position of a cross-section of the head of the rail according to an aspect of the invention, and a region in which it is necessary for a pearlite structure to be made to 90% or more.

Here, FIG. 3 shows appellation at a surface position of a cross-section of the head of the rail according to the aspect of this embodiment, and a region in which the pearlite structure is necessary. The head 3 of the rail includes a top head 1, and corner heads 2 and side heads 9 which are respectively located at both ends of the top head 1. The top head 1 is an approximately flat region extending along a longitudinal direction of the rail and is located at the top of the head of the rail. The side heads 9 are approximately flat regions extending along the longitudinal direction of the rail and are located at sides of the head of the rail. Each of the corner heads 2 is a region including a rounded corner extending between the top head 1 and each of the side heads 9 along the longitudinal direction of the rail, and an upper half of the side head 9 (upper side in relation to the half of the side head 9 along a vertical direction). One of the corner heads 2 is a gauge corner (G.C.) which mainly comes into contact with a wheel.

A region including a surface of the top head 1 and a surface of the corner heads 2 is referred to as a surface of the top head of the rail. This region is a region which comes into contact with the wheel with the highest frequency in the rail.

A range from the surface of the corner head 2 and the top head 1 (surface of the top head of the rail) to a depth of 30 mm is referred to as a head surface 3*a* (oblique line portion). As shown in FIG. 3, in the head surface 3*a* from the surface of the corner head 2 and the top head 1 to a depth of 30 mm, when 95% or more of the structure is composed of the pearlite structure, the improvement of the wear resistance of the rail and the internal fatigue damage resistance is realized.

Accordingly, it is preferable that the pearlite structure be disposed at the head surface 3*a* at which the wheel and the rail mainly come into contact with each other and in which the wear resistance and the internal fatigue damage resistance are demanded. A structure of a portion, in which the characteristics are not necessary, other than the head surface may be a structure other than the pearlite structure.

In addition, it is preferable that the structure of the head surface of the rail according to this embodiment be the pearlite structure as limited above. However, in accordance with chemical components of the rail and manufacturing method of the rail such as a heat treatment, a slight amount of pro-eutectoid structure, pro-eutectoid cementite structure, bainite structure, or martensite structure may be mixed-in into the structure within a range of less than 5% by area ratio. However, even when these structures are mixed-in, there is no large adverse effect on the internal fatigue damage resistance inside the head of the rail or the wear resistance of the head of the rail. Accordingly, with regard to the structure of the rail, a structure, in which a slight amount of pro-eutectoid ferrite structure, pro-eutectoid cementite structure, bainite structure, and martensite structure are mixed-in, may be included in a ratio of less than 5% by area ratio. In other words, 95% or more of the structure of the head of the rail of the invention may be the pearlite structure, and it is more preferable that 98% or more of the structure of the head of the rail be set to the pearlite structure to sufficiently improve the internal fatigue damage resistance and the wear resistance. In addition, structures other than the pearlite structure, which are described in a microstructure column in Table 1-1, Table 1-2, and Table 2 in Examples, represent an amount of 5% or more by area ratio.

To obtain a rail in which 95% or more of structure is composed of the pearlite structure by area % in a range from the surface of the head of the rail to a depth of 30 mm, it is necessary to set the amounts of C, Si, and Mn within the above-described defined ranges.

[Table 1-1]

[Table 1-2]

[Table 2]

(3) Reason for Limiting Average Grain size of Pearlite Block Inside Head of Rail First, the reason for limiting the average grain size of the pearlite block inside the head of the rail to a range of 120 μm to 200 μm will be described.

As the average grain size of the pearlite block decreases, an area of a pearlite block boundary in the pearlite structure increases. As the area of the pearlite block boundary increases, the number of small fatigue cracks that are generated from the pearlite block boundary increases. When the average grain size of the pearlite block is less than 120 μm, one of the small fatigue cracks selectively propagates, and thus the internal fatigue damage tends to be generated. In addition, when the average grain size of the pearlite block exceeds 200 μm, generation of the fatigue crack is less, but a brittle crack is generated from the tip end of the fatigue crack that selectively propagates, and thus the internal fatigue damage tends to be generated due to brittle fracture. Accordingly, the average grain size of the pearlite block inside the head of the rail is limited to a range of 120 μm to 200 μm. In addition, to stably improve the internal fatigue damage resistance, it is preferable that the average grain size of the pearlite block inside the head of the rail be set to a range of 150 μm to 180 μm.

Here, a method of measuring the average grain size of the pearlite block will be described. A sample is cut out from a transverse section in a range with a depth of 20 mm to 30 mm from a surface of the head of the rail shown in FIG. 3, and the transverse section is subjected to polishing with diamond paste of 1 μm diameter particles, and then electrolytic polishing is performed. The polished cross-section is used for measurement of the average grain size of the pearlite block.

Figure 4:
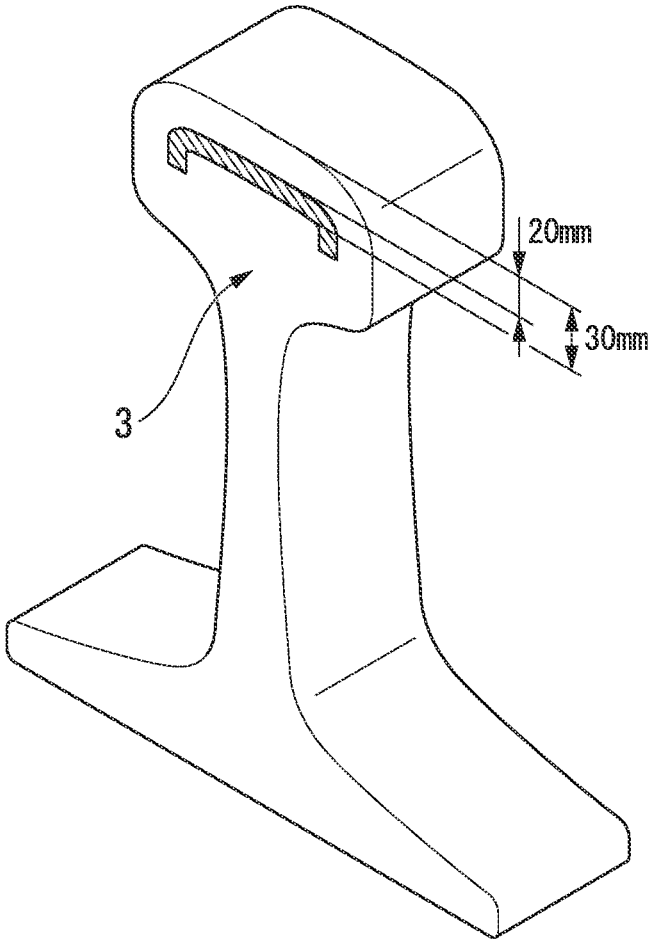
FIG. 4 is a view showing a measuring region of pearlite block on a transverse section of the rail.

In addition, the transverse section represents a cross-section perpendicular to the longitudinal direction of the rail as shown in FIG. 4. A range, which is U-shaped indicated by an oblique line in the drawing and which extends in a range with a depth of 20 mm to 30 mm from a surface of the head of the rail, is a measurement region of the pearlite block.

As a pearlite block measurement method, an electron back scattering pattern (EBSP) method is used. Measurement conditions are as follows.

<Method of Measuring Grain Size of Pearlite Block Inside Head of Rail>

Measurement Conditions

Apparatus: High-resolution scanning electron microscope (SEM)

Collection of test specimen for measurement: Sample is cut out from the transverse section in a range from with a depth of 20 mm to 30 mm from a surface of the head of the rail.

Preliminary treatment: Transverse section is mechanically polished with diamond paste of 1 μm diameter particles and then electrolytic polishing is performed.

Method of Measuring Grain Size

[1] Measurement visual field: 1000 μm×1000 μm

[2] Diameter of SEM electron beam: 30 nm

[3] Measurement step (interval): 1.0 μm to 2.0 μm

[4] Recognition of grain boundary: Boundary (high-angle grain boundary) of adjacent pearlite block grains in which a difference in crystal orientation is 15° or higher is recognized as a pearlite block boundary.

[5] Measurement of Grain Size: Area of the pearlite block grain is measured, and then a diameter is calculated on the assumption that the pearlite block has a circular shape.

Calculation of Average Grain Size

Average grain size: 10 or more viewing fields are selected from an arbitrary cross-section in a range with a depth of 20 mm to 30 mm from a surface of the head of the rail, the measurement is performed with respect to respective pearlite block grains at each of the viewing fields, and an average value of diameters of the respective pearlite block grains which are obtained by the measurement is set as the average grain size of the pearlite block of the rail.

Next, a description will be given to the reason for limiting a position, at which the average grain size of the pearlite block inside the head of the rail is limited, to the range to a depth of 20 mm to 30 mm of the corresponding portion.

The present inventors examined an occurrence position of the internal fatigue damage in the head of the rail, and they have confirmed that the occurrence position concentrates in a range with a depth of 20 mm to 30 mm from a surface of the head of the rail. Therefore, the position, at which the average grain size of the pearlite block is limited, is limited to the range to the depth of 20 mm to 30 mm of the corresponding portion.

(4) Reason for Limiting Average Hardness Inside Head of Rail

First, a description will be given to the reason for limiting the average hardness in a range with a depth of 20 mm to 30 mm from a surface of the head of the rail to a range of Hv 350 to Hv 460 in an aspect of the invention.

When the average hardness inside the head of the rail is less than Hv 350, strengthening of the pearlite block boundary may not be sufficient and the improvement of the internal fatigue damage resistance may not be recognized. In addition, when the average hardness inside the head of the rail exceeds Hv 460, generation of a brittle crack from the tip end of the fatigue crack that selectively propagates is promoted due to embrittlement of the pearlite structure, and thus the internal fatigue damage tends to be generated due to brittle fracture. Therefore, the average hardness inside the head of the rail may be limited to a range of Hv 350 to Hv 460. In addition, to stably improve the internal fatigue damage resistance, it is preferable that the average hardness inside the head of the rail be set to a range of Hv 380 to Hv 440.

Next, a description will be given to the reason for limiting the position, at which the average hardness inside the head of the rail is limited, may be limited to a range with a depth of 20 mm to 30 mm from a surface of the head of the rail.

The present inventors examined the generation position of the internal fatigue damage in the head of the rail, and as a result, they have confirmed that the generation position concentrates in a range with a depth of 20 mm to 30 mm from a surface of the head of the rail. Therefore, the position, at which the average hardness is limited, may be limited to a range with a depth of 20 mm to 30 mm from a surface of the head of the rail. In addition, a measurement method is as follows.

<Method of Measuring Hardness Inside Head of Rail>

Measurement Conditions

Apparatus: Vickers hardness tester (load: 98 N)

Collection of test specimen for measurement: Sample is cut out from the transverse section in a range with a depth of 20 mm to 30 mm from a surface of the head of the rail.

Preliminary treatment: Transverse section is mechanically polished with diamond paste of 1 μm diameter particles.

Measurement method: Measurement is performed in accordance with JIS Z 2244.

Calculation of Average hardness:

Average hardness: Measurement is performed with respect to 20 points on an arbitrary cross-section in a range with a depth of 20 mm to 30 mm, and an average value of measured values is set as the average hardness of the rail.

(5) Method of Controlling Grain Size of Pearlite Block Inside Head

To control the grain size of the pearlite block, it is necessary to control a grain size of austenite during hot-rolling which is a prior structure of pearlite transformation. It is necessary to control the austenite grain size to a range of 150 μm to 300 μm so as to set the average grain size of the pearlite block inside the head to a range of 120 μm to 200 μm.

In a case of performing natural cooling or a heat treatment (accelerated cooling) immediately after a hot-rolling, it is necessary to control a temperature and a rolling reduction during hot-rolling so as to control the austenite grain size. In addition, in a case of reheating a rail for a heat treatment after the hot-rolling separately from the above-described accelerated cooling, it is necessary to control a reheating temperature and a holding time so as to control the austenite grain size.

To clarify a preferred control range of the temperature during the hot-rolling, the present inventors have performed hot-rolling with respect to steel in which an amount of carbon is 0.90% (0.90% C-0.50% Si-0.90% Mn-0.0150% P-0.0120% S) under conditions in which a final rolling temperature is changed to various values. Subsequently, the steel is performed a heat treatment (accelerated cooling) to prepare a rail. The present inventors have examined the average grain size of the pearlite block in a range with a depth of 20 mm to 30 mm from a surface of the head of the rail (inside the head).

Figure 8:
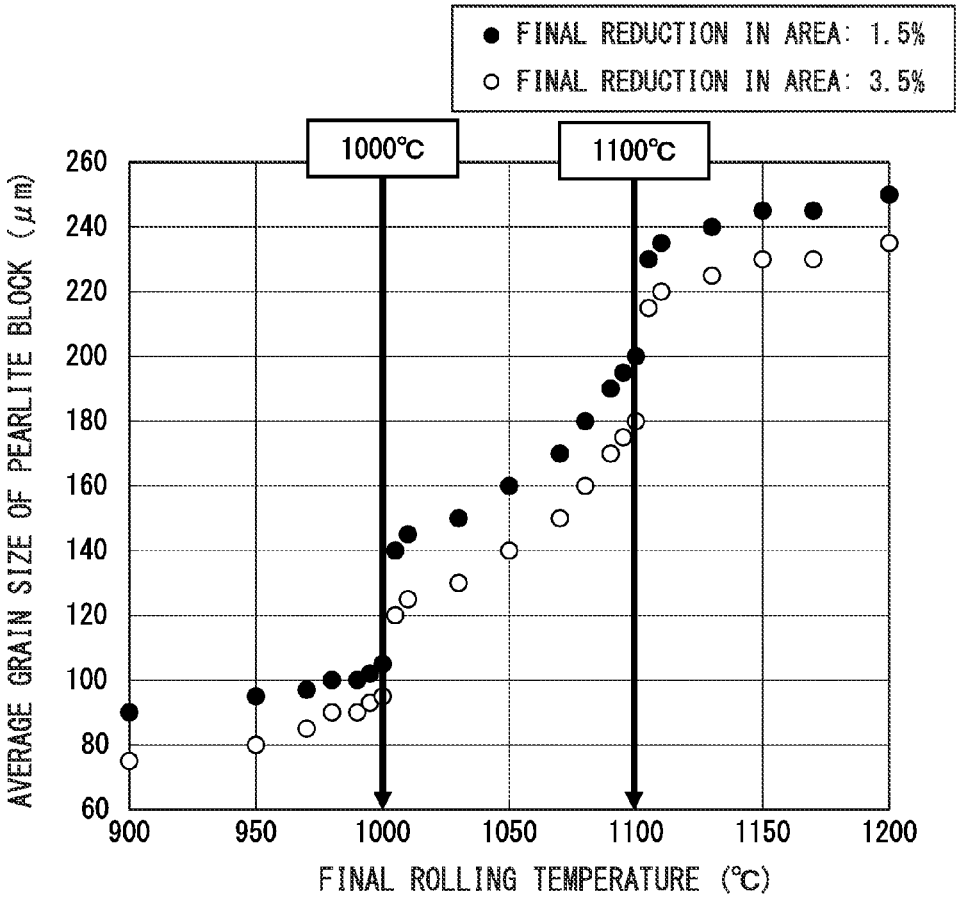
FIG. 8 is a graph showing a relationship between a final rolling temperature (on surface of the head of the rail) and the average grain size of the pearlite block inside the head.

FIG. 8 shows a relationship between a final rolling temperature (surface of the head of the rail) and the average grain size of the pearlite block inside the head. In a range in which a final reduction in area is constant, the average grain size of the pearlite block and the final rolling temperature had a strong correlation. Here, the final reduction in area represents a percentage of an amount of reduction area with respect to a cross-sectional area of steel before initiation of a rolling (a difference between a cross-sectional area of steel before initiation of the rolling and a cross-sectional area of steel after completion of the rolling). The present inventors have confirmed that when the final rolling temperature (surface of the head of the rail) is in a range that is higher than 1000° C. and equal to or lower than 1100° C., it is possible to control the average grain size of the pearlite block inside the head of the rail of a range of 120 μm to 200 μm, and thus it is possible to improve the internal fatigue damage resistance.

In addition, to clarify a preferred control range of the rolling reduction during the hot-rolling, the present inventors have performed hot-rolling with respect to steel in which an amount of carbon is 0.90% (0.90% C-0.50% Si-0.90% Mn-0.0150% P-0.0120% S) under conditions in which a final reduction in area is changed to various values. Subsequently, the steel is performed a heat treatment (accelerated cooling) to prepare a rail. The present inventors have examined the average grain size of the pearlite block in a range with a depth of 20 mm to 30 mm from a surface of the head of the rail (inside the head).

Figure 9:
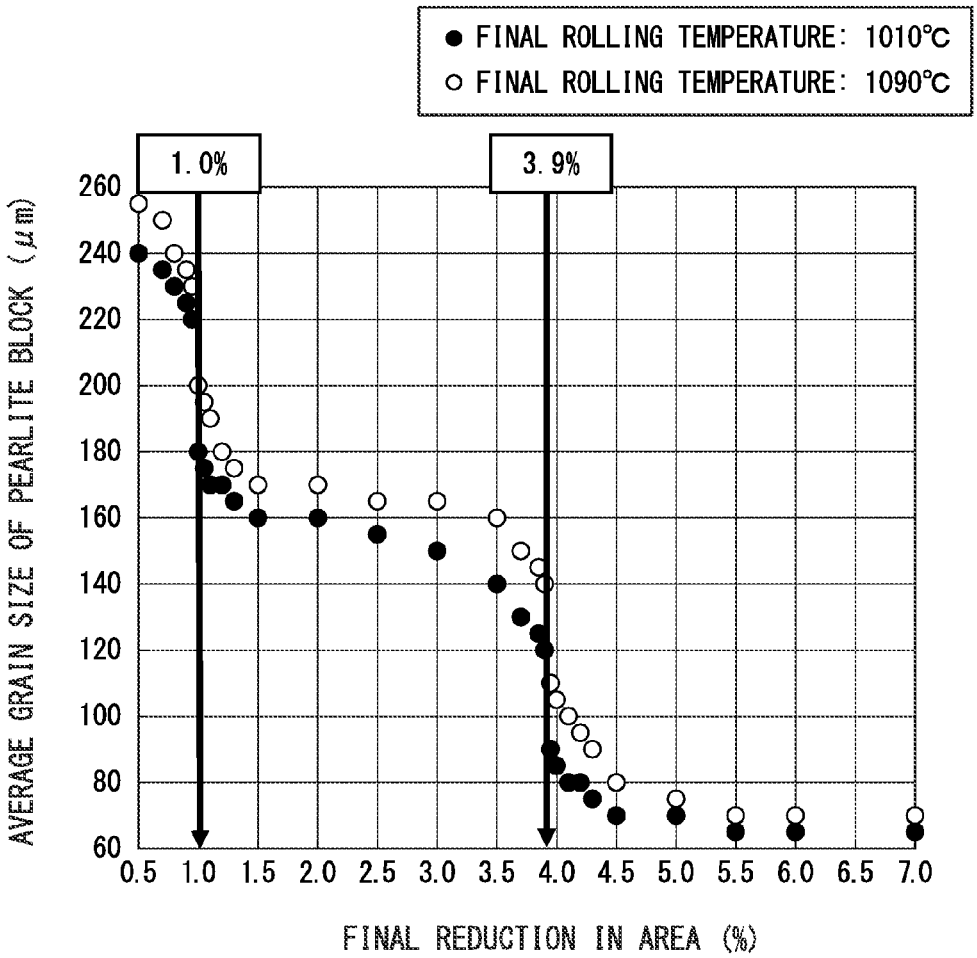
FIG. 9 is a graph showing a relationship between a final reduction in area and the average grain size of the pearlite block inside the head.

FIG. 9 shows a relationship between the final reduction in area and the average grain size of the pearlite block inside the head. The present inventors have found that when the final rolling temperature is in a constant range, the average grain size of the pearlite block and the final reduction in area have a strong correlation. The present inventors have confirmed that when the final reduction in area is in a range of 1.0% to 3.9%, it is possible to control the average grain size of the pearlite block inside the head of the rail to a range of 120 μm to 200 μm, and it is possible to improve the internal fatigue damage resistance.

When an examination is made based on the experiment results, it is necessary for hot-rolling conditions of the rail to satisfy both of the final rolling temperature that is higher than 1000° C. and equal to or lower than 1100° C. (surface of the head of the rail), and the final rolling reduction in area of 1.0% to 3.9% so as to control the average grain size of the pearlite block inside the head of the rail in a range of 120 μm to 200 μm.

In addition, in a case of reheating the rail for a heat treatment after the hot-rolling, it is necessary to set a reheating temperature in a range that is higher than 1000° C. and is equal to or lower than 1150° C. (surface of the head of the rail), and to set a holding time for complete heating to the inside of the head in a range of 5 minutes to 10 minutes so as to control an austenite grain size. In this case, it is not necessary to define the final rolling temperature and the final rolling reduction in area.

(6) Method of Controlling Hardness Inside Head of Rail

To control the hardness inside the head of the rail, it is preferable to control a cooling rate of the head of the rail during the heat treatment. In a case of performing the heat treatment (accelerated cooling) immediately after the hot-rolling, it is preferable to control an accelerated cooling rate in the surface of the head of the rail in a range of 3° C./sec to 10° C./sec (cooling temperature range: 800° C. to 600° C.). In addition, in a case of reheating the rail for a heat treatment after the hot-rolling, it is preferable to control the accelerated cooling rate in the surface of the head of the rail in a range of 5° C./sec to 15° C./sec (cooling temperature range: 800° C. to 600° C.). In addition, with regard to details of the cooling method, it is preferable to refer to a method described in Patent Document 5, Patent Document 6, and the like.

EXAMPLES

Next, Examples will be described.

Figure 5:
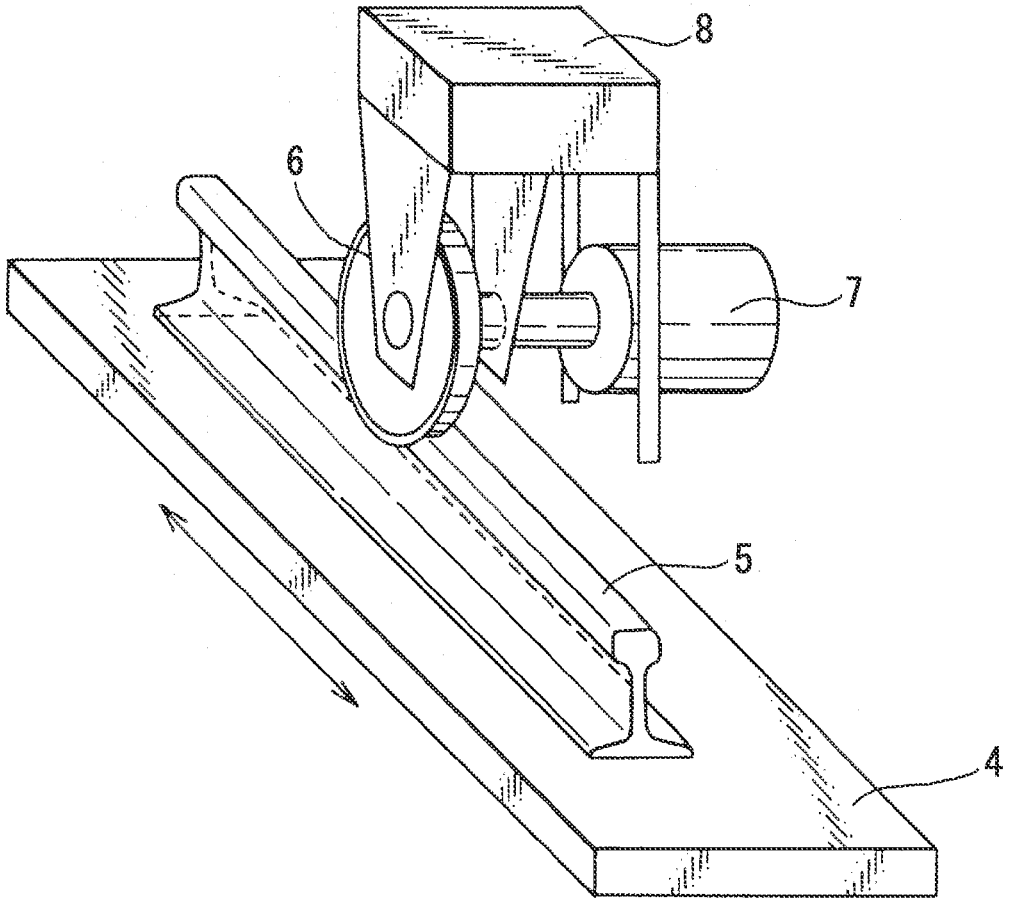
FIG. 5 is a view showing an overview of a rolling contact fatigue test.

Tables 1-1 and 1-2 show chemical components and characteristics of rails of the invention. In Tables 1-1 and 1-2, chemical component values, a microstructure of a head of each of the rails, the average grain size of the pearlite block inside the head of the rail, and the average hardness inside the head of the rail are shown. In addition, a rolling contact fatigue test result (fatigue limit load) obtained by the method shown in FIG. 5 is shown in combination. In addition, in Examples in which the microstructure of the head of the rail is described as a pearlite structure, a small amount of pro-eutectoid ferrite structure, a pro-eutectoid cementite structure, a bainite structure, or a martensite structure may be mixed-in into the microstructure in an amount of 5% or less by area ratio.

Table 2 shows chemical components and characteristics of comparative rails. In Table 2, chemical component values, a microstructure of a head of each of the rails, the average grain size of the pearlite block inside the head of the rail, and the average hardness inside the head of the rail are shown. In addition, a rolling contact fatigue test result (fatigue limit load) obtained by the method shown in FIG. 5 is shown in combination. In addition, in Comparative Examples in which the microstructure of the head of the rail is described as a pearlite structure, a small amount of pro-eutectoid ferrite structure, a pro-eutectoid cementite structure, a bainite structure, or a martensite structure may be mixed-in into the microstructure in an amount of 5% or less by area ratio.

In addition, in a case of performing the heat treatment (accelerated cooling) or the natural cooling immediately after the hot-rolling, outlines of processes of manufacturing the rails of the invention and the comparative rails, which are shown in Tables 1-1, 1-2, and 2, are as follows (hereinafter, referred to as a manufacturing process example a).

(a-1) Molten steel-manufacturing process
(a-2) Component-adjusting process
(a-3) Casting (blooming) process
(a-4) Reheating process
(a-5) Hot-rolling process
(a-6) Natural cooling process or heat treatment (accelerated cooling) process In addition, in a case of reheating the rail for a heat treatment after the hot-rolling, outlines of processes of manufacturing a rail and manufacturing conditions are as follows (hereinafter, referred to as a manufacturing process example b).

(b-1) Molten steel-manufacturing process
(b-2) Component-adjusting process
(b-3) Casting process
(b-4) Reheating process
(b-5) Hot-rolling process
(b-6) Natural cooling process
(b-7) Reheating process (for rails)
(b-8) Heat treatment (accelerated cooling) process In addition, outlines of manufacturing conditions of the rails of the invention which are shown in Tables 1-1 and 1-2 are as follows.

Reheating Conditions in Reheating Processes (a-4, b-4) Before Hot-Rolling Process Reheating temperature: 1250° C. to 1300° C.

Hot-Rolling Conditions in Hot-Rolling Process (a-5)

Final rolling temperature: 1000° C. to 1100° C. (surface of the head of the rail)

Final rolling reduction in area: 1% to 3.9%

Reheating Conditions in Reheating Process (b-7) after Hot-Rolling Process

Reheating temperature: 1000° C. to 1150° C. (surface of the head of the rail)

Retention time: 5 minutes to 10 minutes

Heat Treatment Conditions of Head of Rail (only Examples to which Heat Treatment is Applied)

Accelerated cooling rate in the heat treatment (accelerated cooling) process (a-6) immediately after the hot-rolling process: 3° C./sec to 10° C./sec (cooling temperature range: 800° C. to 600° C.)

Accelerated cooling rate in the heat treatment (accelerated cooling) process (b-8) after the reheating process (for rails): 5° C./sec to 15° C./sec (cooling temperature range: 800° C. to 600° C.)

Details of rails of the invention and comparative rails which are shown in Tables 1-1, 1-2, and 2 are as follows.

(1) Rails of Invention (44 Pieces)

Symbols A1 to A44: Rails in which the chemical component value, the microstructure of the head of each of the rails, and the average grain size of the pearlite block inside the head of the rail are in the range of the invention.

(2) Comparative Rails (17 Pieces)

Symbols B1 to B8 (8 pieces): Rails in which the amount of C, Si, Mn, P, or S, or the microstructure of the head of each of the rails is out of range of the invention.

Symbols B9 to B17: Rails in which the average grain size of the pearlite block inside the head of each of the rails is out of the range of the invention.

Tables 3-1 and 3-2 show manufacturing conditions and characteristics of the rails in a case of processing steel described in Tables 1-1 and 1-2. Tables 3-1 and 3-2 show hot-rolling conditions, reheating conditions, heat treatment conditions of the head of the rail, a microstructure of the head of the rail, an average grain size of the pearlite block inside the head of the rail, and average hardness inside the head of the rail. In addition, a rolling contact fatigue test result (fatigue limit load) obtained by the method shown in FIG. 5 is shown in combination.

In addition, various test conditions are as follows.

<Method of Evaluating Rolling Contact Fatigue Property>

Test Conditions

Tester: Rolling contact fatigue tester (refer to FIG. 5)

Shape of test specimen; Rail: 136 pound rail (length: 2 m)/Wheel: AAR type (diameter: 920 mm)

Road; Radial: 50 kN to 300 kN/Thrust: 20 kN

Lubrication: Dry+Oil (intermittent oiling)

Number of repeating times: 2,000,000 times to the maximum

Evaluation

Fatigue limit load: the maximum value of a vertical load, with which the internal fatigue damage does not occur when rolling was repeated for 2,000,000 times, was obtained.

Acceptance standard of the fatigue limit load: Fatigue limit load of 150 kN or more <Method of Measuring Pearlite Block Inside Head of Rail>

Measurement Conditions

Apparatus: High-resolution scanning electron microscope

Collection of test specimen for measurement: Sample was cut out from the transverse section in a range with a depth of 20 mm to 30 mm from a surface of the head of the rail.

Preliminary treatment: Transverse section was mechanically polished with diamond paste of 1 μm diameter particles and then electrolytic polishing was performed.

Measurement Method

[1] Measurement visual field: 1000 μm×1000 μm

[2] Diameter of SEM electron beam: 30 nm

[3] Measurement step (interval): 1.0 μm to 2.0 μm

[4] Recognition of grain boundary: Boundary (high-angle grain boundary) of adjacent pearlite block grains in which a difference in crystal orientation is 15° or higher was recognized as a pearlite block boundary.

[5] Measurement of Grain Size: Area of the pearlite block grain was measured, and then a diameter was calculated on the assumption that the pearlite block has a circular shape.

Calculation of Average Grain Size

Average grain size: 10 or more viewing fields were selected from an arbitrary cross-section in a range with a depth of 20 mm to 30 mm, the measurement was performed with respect to respective pearlite block grains at each of the visual fields, and an average value of diameters of the respective pearlite block grains which were obtained by the measurement was set as the average grain size of the pearlite block of the rail.

[Table 3-1]

[Table 3-2]

<Method of Measuring Hardness Inside Head of Rail>

Measurement Conditions

Apparatus: Vickers hardness tester (load: 98 N)

Method of collecting of test specimen for a measurement: Sample was cut out to expose a transverse section in a range with a depth of 20 mm to 30 mm from a surface of the head of the rail.

Measurement preliminary processing method: Transverse section was mechanically polished with diamond paste of 1 μm diameter particles.

Measurement method: Measurement was performed in accordance with JIS Z 2244.

Calculation of Average hardness:

Average hardness: Hardness measurement was performed with respect to 20 arbitrary points on the transverse section of the head of the rail in a range with a depth of 20 mm to 30 mm, and an average value of measured values that were obtained was set as the average hardness of the rail.

As shown in Tables 1-1, 1-2, and 2, in the rails of the invention (symbols A1 to A44), the amounts of C, Si, Mn, P, and S in the steel were set in the limited range, and thus generation of the pro-eutectoid ferrite structure, the pro-eutectoid cementite structure, the bainite structure, and the martensite structure was suppressed, and the structure of the head of the rail was mainly the pearlite structure. In addition, in the rails of the invention, the average grain size of the pearlite block inside the head of the rail was controlled. According to this, in the rails of the invention, the internal fatigue damage resistance inside the head of the rail could be improved.

In Comparative Example B1, since the amount of C was less than the defined range, the pro-eutectoid ferrite was excessively included in the structure in a range from the surface of the head of the rail to a depth of 30 mm. In Comparative Example B2, since the amount of C was more than the defined range, cementite was excessively included in the structure. In Comparative Example B3, since the amount of Si was less than the defined range, generation of the pro-eutectoid cementite was not sufficiently suppressed. In Comparative Example B4, since the amount of Si was more than the defined range, hardenability of steel significantly increased, and thus the martensite structure was excessively generated. In Comparative Example B5, since the amount of Mn was less than the defined range, the pearlite transformation was not sufficiently stabilized, and thus the pro-eutectoid ferrite structure was excessively generated. In Comparative Example B6, since the amount of Mn was more than the defined range, hardenability of steel significantly increased, and thus the martensite structure was excessively generated. In Comparative Example B7, since the pearlite area ratio and the average grain size of the pearlite block in the defined region were in the defined range, but the amount of P was more than the defined range, the pearlite structure was brittle. In Comparative Example B8, since the pearlite area ratio and the average grain size of the pearlite block in the defined region were in the defined range, but the amount of S was more than the defined range, coarse MnS was generated. The fatigue limit load in Comparative Examples B1 to B8 was not sufficient due to the above-described situations.

Figure 6:
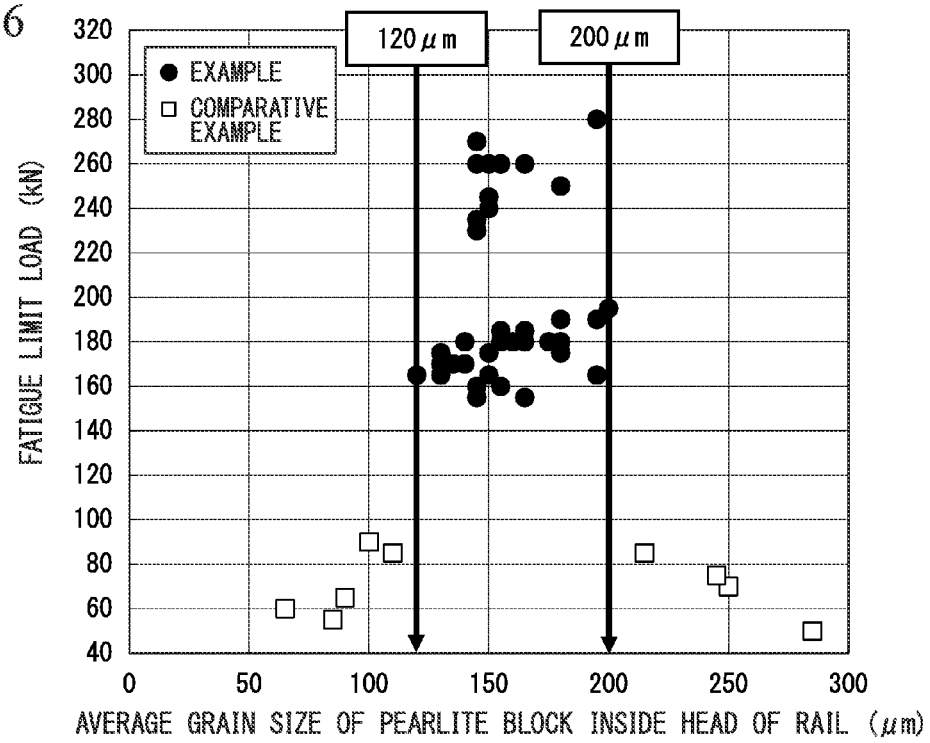
FIG. 6 is a view showing a relationship between the average grain size of the pearlite block inside the head of the rail and the fatigue limit load in rail steel (symbols A1 to A44) of the invention and comparative rail steel (symbols B9 to B17).

In addition, as shown in Tables 1-1, 1-2, and 2, and FIG. 6, in the rail steel of the invention (symbols A1 to A44), the amount of C, Si, Mn, P, and S, and the average grain size of the pearlite block inside the head of the rail were set in the limited range, and thus the internal fatigue damage resistance could be improved in comparison to the comparative rail steel (symbols B9 to B17). In Comparative Examples B9, B10, B16, and B17, since the chemical composition was in the defined range, but the average grain size of the pearlite block was more than the defined range, the pearlite structure was brittle, and thus the fatigue limit load was not sufficient. In Comparative Examples B11 to B15, since the chemical composition was in the defined range, but the average grain size of the pearlite block was less than the defined range, the area of the pearlite block boundary increased, and thus the fatigue limit load was not sufficient.

Figure 7:
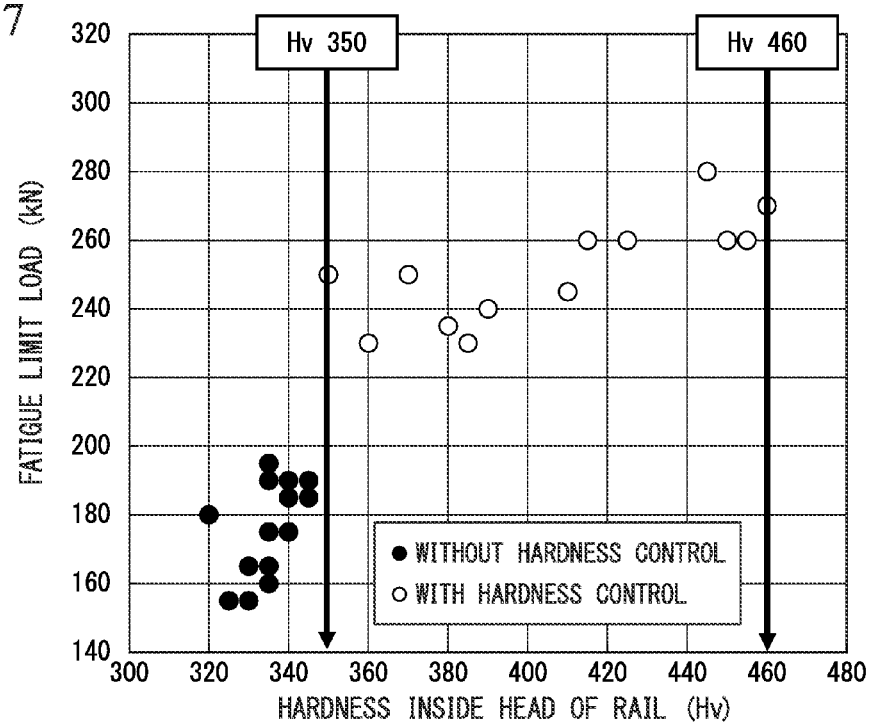
FIG. 7 is a view showing a relationship between hardness inside the head of the rail and the fatigue limit load in rail steel (symbols A9 to A11, A13 to A15, A17 to A19, A21 to A23, A24 to A26, A28 to A30, A31 to A33, A36 to A38, and A40 to A42) of the invention.

In addition, as shown in Tables 1-1, 1-2, 2, and FIG. 7, in the rail steel of the invention (symbols A9 to A11, A13 to A15, A17 to A19, A21 to A23, A24 to A26, A28 to A30, A31 to A33, A36 to A38, and A40 to A42), the average grain size of the pearlite block inside the head of the rail was controlled in the limited range, and in addition to this, the hardness inside the head of the rail was controlled in the defined range, and thus the internal fatigue damage resistance could be further improved.

In addition, as shown in Tables 3-1 and 3-2, the hot-rolling conditions and the heat treatment (accelerated cooling) conditions, or the reheating temperature conditions and the temperature holding time conditions after the hot-rolling were set to the above-described conditions, and thus the average grain size of the pearlite block inside the head of the rail was controlled in the limited range. As a result, the fatigue limit load could be improved (Present Examples A45, A47, A49, A51, A53, and A55). In addition to this, the heat treatment conditions of the head of the rail were set in the defined range, and thus the hardness inside the head of the rail was controlled in the limited range. As a result, the internal fatigue damage resistance of the rail could be further improved (Present Examples A46, A48, A50, A52, A54, and A56).

In Comparative Examples B18, B20, B23, and B25, since the final rolling temperature during the hot-rolling was out of the defined range, the average grain size of the pearlite block was out of the defined range, and thus the fatigue limit load was not sufficient. In Comparative Examples B19, B21, B22, and B24, since the final rolling reduction in area during the hot-rolling was out of the defined range, the average grain size of the pearlite block was out of the defined range, and thus the fatigue limit load was not sufficient. In Comparative Examples B26 and B28, since the reheating temperature in the reheating after the hot-rolling was out of the defined range, the average grain size of the pearlite block was out of the defined range, and thus the fatigue limit load was not sufficient. In Comparative Examples B27 and B29, since the holding time in the reheating was out of the defined range, the average grain size of the pearlite block was out of the defined range, and thus the fatigue limit load was not sufficient.

INDUSTRIAL APPLICABILITY

In the rail of the invention, since the structure and the average grain size of the pearlite block inside the head of the rail were controlled, high internal fatigue damage resistance was provided, and thus the service life of the rail is very long. In addition, since the service life of the rail of the invention is very long, the rail can be used in a region which has not yet been developed until now and in which a natural environment is severe.

BRIEF DESCRIPTION OF THE REFERENCE SYMBOLS

1: Top head
2: Corner head
3: Head of rail
3*a*: Head surface (range from surface of head of rail to depth of 30 mm, oblique line portion)
4: Slider for rail movement
5: Rail
6: Wheel
7: Motor
8: Load control device
9: Side head

TABLE 1-1

PROPERTIES AND CHEMICAL COMPONENTS OF RAIL OF THE INVENTION

| | SAMPLES | CHEMICAL COMPONENTS(mass %) | | | | | | | | | | | | | | | | | |
|---|---|---|---|---|---|---|---|---|---|---|---|---|---|---|---|---|---|---|---|
| | No. | C | Si | Mn | P | S | Cr | Mo | Co | B | Cu | Ni | V | Nb | Ti | Mg | Ca | REM | Zr |
| EXAMPLES | A1 | 0.75 | 0.25 | 0.95 | 0.0120 | 0.0120 | — | — | — | — | — | — | — | — | — | — | — | — | — |
| | A2 | 1.20 | 0.25 | 0.95 | 0.0120 | 0.0120 | — | — | — | — | — | — | — | — | — | — | — | — | — |
| | A3 | 0.85 | 0.10 | 0.80 | 0.0180 | 0.0150 | — | — | — | — | — | — | — | — | — | — | — | — | — |
| | A4 | 0.85 | 2.00 | 0.80 | 0.0180 | 0.0150 | — | — | — | — | — | — | — | — | — | — | — | — | — |
| | A5 | 0.90 | 0.70 | 0.10 | 0.0150 | 0.0080 | — | — | — | — | — | — | — | — | — | — | — | — | — |
| | A6 | 0.90 | 0.45 | 2.00 | 0.0150 | 0.0080 | — | — | — | — | — | — | — | — | — | — | — | — | — |
| | A7 | 1.00 | 0.80 | 0.80 | 0.0250 | 0.0120 | — | — | — | — | — | — | — | — | — | — | — | — | — |
| | A8 | 1.10 | 0.45 | 0.45 | 0.0120 | 0.0250 | — | — | — | — | — | — | — | — | — | — | — | — | — |
| | A9 | 0.76 | 0.40 | 0.85 | 0.0160 | 0.0130 | 0.22 | — | — | — | — | — | — | — | — | — | — | — | — |
| | A10 | 0.76 | 0.40 | 0.85 | 0.0160 | 0.0130 | 0.22 | — | — | — | — | — | — | — | — | — | — | — | — |
| | A11 | 0.76 | 0.40 | 0.85 | 0.0160 | 0.0130 | 0.22 | — | — | — | — | — | — | — | — | — | — | — | — |
| | A12 | 0.77 | 0.50 | 0.75 | 0.0200 | 0.0200 | — | — | — | — | — | 0.10 | — | — | — | — | — | — | — |
| | A13 | 0.80 | 0.25 | 0.85 | 0.0190 | 0.0150 | 0.17 | — | — | — | — | — | 0.032 | — | — | — | — | — | — |
| | A14 | 0.80 | 0.25 | 0.85 | 0.0190 | 0.0150 | 0.17 | — | — | — | — | — | 0.032 | — | — | — | — | — | — |
| | A15 | 0.80 | 0.25 | 0.85 | 0.0190 | 0.0150 | 0.17 | — | — | — | — | — | 0.032 | — | — | — | — | — | — |
| | A16 | 0.80 | 1.50 | 0.25 | 0.0150 | 0.0180 | — | — | — | — | 0.20 | — | — | — | — | — | — | — | — |
| | A17 | 0.80 | 0.80 | 1.15 | 0.0180 | 0.0180 | — | — | — | — | — | — | — | — | — | — | — | — | — |
| | A18 | 0.80 | 0.80 | 1.15 | 0.0180 | 0.0180 | — | — | — | — | — | — | — | — | — | — | — | — | — |

TABLE 1-1-continued

PROPERTIES AND CHEMICAL COMPONENTS OF RAIL OF THE INVENTION

| | | | | | | | | | | | | | | | | | | |
|---|---|---|---|---|---|---|---|---|---|---|---|---|---|---|---|---|---|---|
| A19 | 0.80 | 0.80 | 1.15 | 0.0180 | 0.0180 | — | — | — | — | — | — | — | — | — | — | — | — | — |
| A20 | 0.85 | 0.75 | 1.00 | 0.0200 | 0.0240 | — | — | 0.15 | — | — | — | — | — | — | — | — | — | — |
| A21 | 0.90 | 0.25 | 1.00 | 0.0150 | 0.0180 | 0.25 | — | — | — | — | — | — | — | — | — | — | — | — |
| A22 | 0.90 | 0.25 | 1.00 | 0.0150 | 0.0180 | 0.25 | — | — | — | — | — | — | — | — | — | — | — | — |

| | SAMPLES No. | CHEMICAL COMPONENTS (mass %) N | Al | MICRO-STRUCTURE OF HEAD OF RAIL: DEPTH OF 2 mm FROM SURFACE OF HEAD OF RAIL | DEPTH OF 25 mm FROM SURFACE OF HEAD OF RAIL | AVERAGE GRAIN SIZE OF PEARLITE BLOCK INSIDE HEAD OF RAIL * (μm) | AVERAGE HARDNESS INSIDE HEAD OF RAIL * (Hv, 98N) | ROLLING CONTACT FATIGUE TEST RESULT (FATIGUE LIMIT LOAD) (kN) |
|---|---|---|---|---|---|---|---|---|
| EXAMPLES | A1 | — | — | PEARLITE | PEARLITE | 180 | 300 | 180 |
| | A2 | — | — | PEARLITE | PEARLITE | 140 | 345 | 170 |
| | A3 | — | — | PEARLITE | PEARLITE | 155 | 320 | 180 |
| | A4 | — | — | PEARLITE | PEARLITE | 150 | 340 | 175 |
| | A5 | — | — | PEARLITE | PEARLITE | 175 | 325 | 180 |
| | A6 | — | — | PEARLITE | PEARLITE | 135 | 345 | 170 |
| | A7 | — | — | PEARLITE | PEARLITE | 130 | 330 | 175 |
| | A8 | — | — | PEARLITE | PEARLITE | 140 | 335 | 180 |
| | A9 | — | — | PEARLITE | PEARLITE | 180 | 320 | 180 |
| | A10 | — | — | PEARLITE | PEARLITE | 180 | 335 | 190 |
| | A11 | — | — | PEARLITE | PEARLITE | 180 | 350 | 250 |
| | A12 | — | — | PEARLITE | PEARLITE | 165 | 320 | 180 |
| | A13 | — | — | PEARLITE | PEARLITE | 180 | 335 | 175 |
| | A14 | — | — | PEARLITE | PEARLITE | 180 | 340 | 190 |
| | A15 | — | — | PEARLITE | PEARLITE | 180 | 370 | 250 |
| | A16 | — | — | PEARLITE | PEARLITE | 200 | 335 | 195 |
| | A17 | — | — | PEARLITE | PEARLITE | 150 | 335 | 165 |
| | A18 | — | — | PEARLITE | PEARLITE | 150 | 340 | 175 |
| | A19 | — | — | PEARLITE | PEARLITE | 150 | 390 | 240 |
| | A20 | — | — | PEARLITE | PEARLITE | 130 | 345 | 170 |
| | A21 | — | — | PEARLITE | PEARLITE | 150 | 335 | 165 |
| | A22 | — | — | PEARLITE | PEARLITE | 150 | 410 | 245 |

* RANGE WITH DEPTH OF 20 mm TO 30 mm FROM SURFACE OF HEAD OF RAIL

TABLE 1-2

PROPERTIES AND CHEMICAL COMPONENTS OF RAIL OF THE INVENTION

| | SAMPLES No. | CHEMICAL COMPONENTS(mass %) C | Si | Mn | P | S | Cr | Mo | Co | B | Cu | Ni | V | Nb | Ti | Mg | Ca |
|---|---|---|---|---|---|---|---|---|---|---|---|---|---|---|---|---|---|
| EXAMPLES | A23 | 0.90 | 0.25 | 1.00 | 0.0150 | 0.0180 | 0.25 | — | — | — | — | — | — | — | — | — | — |
| | A24 | 0.90 | 0.50 | 0.85 | 0.0180 | 0.0120 | — | — | — | — | — | — | — | — | — | — | — |
| | A25 | 0.90 | 0.50 | 0.85 | 0.0180 | 0.0120 | — | — | — | — | — | — | — | — | — | — | — |
| | A26 | 0.90 | 0.50 | 0.85 | 0.0180 | 0.0120 | — | — | — | — | — | — | — | — | — | — | — |
| | A27 | 0.95 | 0.80 | 0.80 | 0.0180 | 0.0120 | — | 0.02 | — | — | — | — | — | — | — | — | — |
| | A28 | 1.00 | 0.85 | 0.65 | 0.0150 | 0.0245 | — | — | — | — | — | — | — | 0.0025 | 0.0030 | — | — |
| | A29 | 1.00 | 0.85 | 0.65 | 0.0150 | 0.0245 | — | — | — | — | — | — | — | 0.0025 | 0.0030 | — | — |
| | A30 | 1.00 | 0.85 | 0.65 | 0.0150 | 0.0245 | — | — | — | — | — | — | — | 0.0025 | 0.0030 | — | — |
| | A31 | 1.00 | 0.55 | 1.00 | 0.0145 | 0.0080 | 0.20 | — | — | — | — | — | — | — | — | — | — |
| | A32 | 1.00 | 0.55 | 1.00 | 0.0145 | 0.0080 | 0.20 | — | — | — | — | — | — | — | — | — | — |
| | A33 | 1.00 | 0.55 | 1.00 | 0.0145 | 0.0080 | 0.20 | — | — | — | — | — | — | — | — | — | — |
| | A34 | 1.05 | 0.15 | 1.50 | 0.0050 | 0.0100 | — | — | — | 0.0025 | — | — | — | — | — | — | — |
| | A35 | 1.05 | 0.85 | 0.65 | 0.0180 | 0.0120 | — | — | — | — | — | — | — | — | — | 0.0025 | 0.0015 |
| | A36 | 1.05 | 0.25 | 1.20 | 0.0150 | 0.0070 | — | — | — | — | — | — | 0.045 | — | — | — | — |
| | A37 | 1.05 | 0.25 | 1.20 | 0.0150 | 0.0070 | — | — | — | — | — | — | 0.045 | — | — | — | — |
| | A38 | 1.05 | 0.25 | 1.20 | 0.0150 | 0.0070 | — | — | — | — | — | — | 0.045 | — | — | — | — |
| | A39 | 1.05 | 0.55 | 0.95 | 0.0150 | 0.0050 | — | — | — | — | — | — | — | — | — | — | — |
| | A40 | 1.10 | 0.50 | 0.35 | 0.0120 | 0.0080 | — | — | — | — | — | — | — | — | — | — | — |
| | A41 | 1.10 | 0.50 | 0.35 | 0.0120 | 0.0080 | — | — | — | — | — | — | — | — | — | — | — |
| | A42 | 1.10 | 0.50 | 0.35 | 0.0120 | 0.0080 | — | — | — | — | — | — | — | — | — | — | — |
| | A43 | 1.15 | 0.50 | 0.85 | 0.0150 | 0.0135 | — | — | — | — | — | — | — | — | — | — | — |
| | A44 | 1.20 | 0.80 | 0.65 | 0.0180 | 0.0060 | — | — | — | — | — | — | — | — | — | — | — |

TABLE 1-2-continued

PROPERTIES AND CHEMICAL COMPONENTS OF RAIL OF THE INVENTION

| | SAMPLES No. | CHEMICAL COMPONENTS (mass %) REM | Zr | N | Al | MICRO-STRUCTURE OF HEAD OF RAIL: DEPTH OF 2 mm FROM SURFACE OF HEAD OF RAIL | DEPTH OF 25 mm FROM SURFACE OF HEAD OF RAIL | AVERAGE GRAIN SIZE OF PEARLITE BLOCK INSIDE HEAD OF RAIL * (μm) | AVERAGE HARDNESS INSIDE HEAD OF RAIL * (Hv, 98N) | ROLLING CONTACT FATIGUE TEST RESULT (FATIGUE LIMIT LOAD) (kN) |
|---|---|---|---|---|---|---|---|---|---|---|
| EXAMPLES | A23 | — | — | — | — | PEARLITE | PEARLITE | 150 | 450 | 260 |
| | A24 | — | — | — | — | PEARLITE | PEARLITE | 165 | 325 | 155 |
| | A25 | — | — | — | — | PEARLITE | PEARLITE | 165 | 340 | 185 |
| | A26 | — | — | — | — | PEARLITE | PEARLITE | 165 | 415 | 260 |
| | A27 | — | — | — | — | PEARLITE | PEARLITE | 145 | 340 | 160 |
| | A28 | — | — | — | — | PEARLITE | PEARLITE | 155 | 335 | 160 |
| | A29 | — | — | — | — | PEARLITE | PEARLITE | 155 | 345 | 185 |
| | A30 | — | — | — | — | PEARLITE | PEARLITE | 155 | 425 | 260 |
| | A31 | — | — | — | — | PEARLITE | PEARLITE | 145 | 360 | 230 |
| | A32 | — | — | — | — | PEARLITE | PEARLITE | 145 | 380 | 235 |
| | A33 | — | — | — | — | PEARLITE | PEARLITE | 145 | 460 | 270 |
| | A34 | — | — | — | — | PEARLITE | PEARLITE | 120 | 345 | 165 |
| | A35 | — | — | — | — | PEARLITE | PEARLITE | 160 | 335 | 180 |
| | A36 | — | — | 0.010 | — | PEARLITE | PEARLITE | 145 | 330 | 155 |
| | A37 | — | — | 0.010 | — | PEARLITE | PEARLITE | 145 | 385 | 230 |
| | A38 | — | — | 0.010 | — | PEARLITE | PEARLITE | 145 | 455 | 260 |
| | A39 | 0.0025 | — | — | — | PEARLITE | PEARLITE | 130 | 340 | 175 |
| | A40 | — | — | — | — | PEARLITE | PEARLITE | 195 | 330 | 165 |
| | A41 | — | — | — | — | PEARLITE | PEARLITE | 195 | 345 | 190 |
| | A42 | — | — | — | — | PEARLITE | PEARLITE | 195 | 445 | 280 |
| | A43 | — | 0.0025 | — | — | PEARLITE | PEARLITE | 135 | 330 | 170 |
| | A44 | — | — | — | 0.0200 | PEARLITE | PEARLITE | 130 | 335 | 165 |

* RANGE WITH DEPTH OF 20 mm TO 30 mm FROM SURFACE OF HEAD OF RAIL

TABLE 2

PROPERTIES AND CHEMICAL COMPONENTS OF RAIL OF COMPARATIVE EXAMPLE

| | SAMPLES No. | CHEMICAL COMPONENTS(mass %) C | Si | Mn | P | S | Cr | Mo | Co | B | Cu | Ni | V | Nb | Ti | Mg | Ca | REM | Zr |
|---|---|---|---|---|---|---|---|---|---|---|---|---|---|---|---|---|---|---|---|
| COMPARATIVE EXAMPLES | B1 | 0.70 | 0.25 | 0.95 | 0.0120 | 0.0120 | — | — | — | — | — | — | — | — | — | — | — | — | — |
| | B2 | 1.30 | 0.25 | 0.95 | 0.0120 | 0.0120 | — | — | — | — | — | — | — | — | — | — | — | — | — |
| | B3 | 1.05 | 0.05 | 0.80 | 0.0180 | 0.0150 | — | — | — | — | — | — | — | — | — | — | — | — | — |
| | B4 | 1.05 | 2.35 | 0.80 | 0.0180 | 0.0150 | — | — | — | — | — | — | — | — | — | — | — | — | — |
| | B5 | 0.90 | 0.70 | 0.05 | 0.0150 | 0.0080 | — | — | — | — | — | — | — | — | — | — | — | — | — |
| | B6 | 0.90 | 0.45 | 2.45 | 0.0150 | 0.0080 | — | — | — | — | — | — | — | — | — | — | — | — | — |
| | B7 | 1.00 | 0.80 | 0.80 | 0.0280 | 0.0120 | — | — | — | — | — | — | — | — | — | — | — | — | — |
| | B8 | 1.10 | 0.45 | 0.45 | 0.0120 | 0.0300 | — | — | — | — | — | — | — | — | — | — | — | — | — |
| | B9 | 0.76 | 0.40 | 0.85 | 0.0160 | 0.0130 | 0.22 | — | — | — | — | — | — | — | — | — | — | — | — |
| | B10 | 0.80 | 0.25 | 0.85 | 0.0190 | 0.0150 | 0.17 | — | — | — | — | — | 0.032 | — | — | — | — | — | — |
| | B11 | 0.80 | 0.80 | 1.15 | 0.0180 | 0.0180 | — | — | — | — | — | — | — | — | — | — | — | — | — |
| | B12 | 0.90 | 0.25 | 1.00 | 0.0150 | 0.0180 | 0.25 | — | — | — | — | — | — | — | — | — | — | — | — |
| | B13 | 0.90 | 0.50 | 0.85 | 0.0180 | 0.0120 | — | — | — | — | — | — | — | — | — | — | — | — | — |
| | B14 | 1.00 | 0.85 | 0.65 | 0.0150 | 0.0245 | — | — | — | — | — | — | — | 0.0025 | 0.0030 | — | — | — | — |
| | B15 | 1.00 | 0.55 | 1.00 | 0.0145 | 0.0080 | 0.20 | — | — | — | — | — | — | — | — | — | — | — | — |
| | B16 | 1.05 | 0.25 | 1.20 | 0.0150 | 0.0070 | — | — | — | — | — | — | 0.045 | — | — | — | — | — | — |
| | B17 | 1.10 | 0.50 | 0.35 | 0.0120 | 0.0080 | — | — | — | — | — | — | — | — | — | — | — | — | — |

TABLE 2-continued

PROPERTIES AND CHEMICAL COMPONENTS OF RAIL OF COMPARATIVE EXAMPLE

| | SAMPLES No. | CHEMICAL COMPONENTS (mass %) N | Al | MICRO-STRUCTURE OF HEAD OF RAIL: DEPTH OF 2 mm FROM SURFACE OF HEAD OF RAIL | DEPTH OF 25 mm FROM SURFACE OF HEAD OF RAIL | AVERAGE GRAIN SIZE OF PEARLITE BLOCK INSIDE HEAD OF RAIL * (μm) | AVERAGE HARDNESS INSIDE HEAD OF RAIL * (Hv, 98N) | ROLLING CONTACT FATIGUE TEST RESULT (FATIGUE LIMIT LOAD) (kN) |
|---|---|---|---|---|---|---|---|---|
| COMPARATIVE EXAMPLES | B1 | — | — | PEARLITE + PRO-EUTECTOID FERRITE | PEARLIIE + PRO-EUTECTOID FERRITE | 180 | 280 | 90 (GENERATION OF PRO-EUTECTOID FERRITE) |
| | B2 | — | — | PEARLITE + PRO-EUTECTOID CEMENTITE | PEARLITE + PRO-EUTECTOID CEMENTITE | 140 | 390 | 85 (GENERATION OF PRO-EUTECTOID CEMENTITE) |
| | B3 | — | — | PEARLITE | PEARLITE + PRO-EUTECTOID CEMENTITE | 155 | 250 | 100 (GENERATION OF PRO-EUTECTOID CEMENTITE) |
| | B4 | — | — | PEARLITE + MARTENSITE | PEARLITE + MARTENSITE | 150 | 480 | 50 (GENERATION OF MARTENSITE) |
| | B5 | — | — | PEARLITE | PEARLITE + PRO-EUTECTOID FERRITE | 175 | 275 | 80 (GENERATION OF PRO-EUTECTOID FERRITE) |
| | B6 | — | — | PEARLITE + MARTENSITE | PEARLITE + MARTENSITE | 135 | 505 | 45 (GENERATION OF MARTENSITE) |
| | B7 | — | — | PEARLITE | PEARLITE | 130 | 330 | 75 (EMBRITTLEMENT OF PEARLITE STRUCTURE) |
| | B8 | — | — | PEARLITE | PEARLITE | 140 | 335 | 65 (GENERATION OF COARSE MnS) |
| | B9 | — | — | PEARLITE | PEARLITE | 215 | 320 | 85 (EMBRITTLEMENT OF PEARLITE STRUCTURE) |
| | B10 | — | — | PEARLITE | PEARLITE | 250 | 340 | 70 (EMBRITTLEMENT OF PEARLITE STRUCTURE) |
| | B11 | — | — | PEARLITE | PEARLITE | 110 | 340 | 85 (INCREASING OF PEARLITE BLOCK BOUNDARY) |
| | B12 | — | — | PEARLITE | PEARLITE | 85 | 335 | 55 (INCREASING OF PEARLITE BLOCK BOUNDARY) |
| | B13 | — | — | PEARLITE | PEARLITE | 90 | 330 | 65 (INCREASING OF PEARLITE BLOCK BOUNDARY) |
| | B14 | — | — | PEARLITE | PEARLITE | 65 | 335 | 60 (INCREASING OF PEARLITE BLOCK BOUNDARY) |
| | B15 | — | — | PEARLITE | PEARLITE | 100 | 420 | 90 (INCREASING OF PEARLITE BLOCK BOUNDARY) |
| | B16 | 0.010 | — | PEARLITE | PEARLITE | 245 | 345 | 75 (EMBRITTLEMENT OF PEARLITE STRUCTURE) |
| | B17 | — | — | PEARLITE | PEARLITE | 285 | 335 | 50 (EMBRITTLEMENT OF PEARLITE STRUCTURE) |

* RANGE WITH DEPTH OF 20 mm TO 30 mm FROM SURFACE OF HEAD OF RAIL

TABLE 3-1

| SAMPLES No. | STEEL | HOT-ROLLING CONDITIONS: FINAL ROLLING TEMPERATURE (° C.) | HOT-ROLLING CONDITIONS: FINAL ROLLING REDUCTION IN AREA (%) | HEAT TREATMENT CONDITIONS: ACCELERATED COOLING RATE (° C./sec) | MICRO-STRUCTURE OF HEAD OF RAIL: DEPTH OF 2 mm FROM SURFACE OF HEAD OF RAIL | MICRO-STRUCTURE OF HEAD OF RAIL: DEPTH OF 25 mm FROM SURFACE OF HEAD OF RAIL | AVERAGE GRAIN SIZE OF PEARLITE BLOCK INSIDE HEAD OF RAIL * (μm) | AVERAGE HARDNESS INSIDE HEAD OF RAIL * (Hv, 98N) | ROLLING CONTACT FATIGUE TEST RESULT (FATIGUE LIMIT LOAD) (kN) |
|---|---|---|---|---|---|---|---|---|---|
| B18 | SAME AS A17 | 900 | 3.0 | — | PEARLITE | PEARLITE | 90 | 340 | 80 (INCREASING OF PEARLITE BLOCK BOUNDARY) |
| B19 | | 1020 | 0.5 | — | PEARLITE | PEARLITE | 205 | 340 | 90 (EMBRITTLEMENT OF PEARLITE STRUCTURE) |
| A45 | | 1020 | 3.0 | — | PEARLITE | PEARLITE | 150 | 340 | 175 |
| A46 | | 1020 | 3.0 | 7.0 | PEARLITE | PEARLITE | 150 | 390 | 240 |
| B20 | SAME AS A40 | 1150 | 3.9 | — | PEARLITE | PEARLITE | 285 | 335 | 50 (EMBRITTLEMENT OF PEARLITE STRUCTURE) |
| B21 | | 1050 | 6.0 | — | PEARLITE | PEARLITE | 110 | 335 | 90 (INCREASING OF PEARLITE BLOCK BOUNDARY) |
| A47 | | 1050 | 3.9 | — | PEARLITE | PEARLITE | 195 | 335 | 190 |
| A48 | | 1050 | 3.9 | 8.0 | PEARLITE | PEARLITE | 195 | 435 | 270 |
| B22 | SAME AS A21 | 1020 | 10.0 | — | PEARLITE | PEARLITE | 85 | 335 | 55 (INCREASING OF PEARLITE BLOCK BOUNDARY) |
| B23 | | 950 | 3.5 | — | PEARLITE | PEARLITE | 100 | 340 | 85 (INCREASING OF PEARLITE BLOCK BOUNDARY) |
| A49 | | 1020 | 3.5 | — | PEARLITE | PEARLITE | 150 | 335 | 175 |
| A50 | | 1020 | 3.5 | 8.0 | PEARLITE | PEARLITE | 150 | 450 | 250 |
| B24 | SAME AS A36 | 1065 | 0.9 | — | PEARLITE | PEARLITE | 245 | 345 | 75 (EMBRITTLEMENT OF PEARLITE STRUCTURE) |
| B25 | | 1120 | 3.0 | — | PEARLITE | PEARLITE | 220 | 345 | 95 (EMBRITTLEMENT OF PEARLITE STRUCTURE) |
| A51 | | 1065 | 3.0 | — | PEARLITE | PEARLITE | 145 | 345 | 180 |
| A52 | | 1065 | 3.0 | 10.0 | PEARLITE | PEARLITE | 145 | 455 | 235 |

* RANGE WITH DEPTH OF 20 mm TO 30 mm FROM SURFACE OF HEAD OF RAIL

TABLE 3-2

| SAMPLES No. | STEEL | REHEATING CONDITIONS: REHEATING TEMPERATURE (° C.) | REHEATING CONDITIONS: RETENTION TIME (min) | HEAT TREATMENT CONDITIONS: ACCELERATED COOLING RATE (° C./sec) | MICRO-STRUCTURE OF HEAD OF RAIL: DEPTH OF 2 mm FROM SURFACE OF HEAD OF RAIL | MICRO-STRUCTURE OF HEAD OF RAIL: DEPTH OF 25 mm FROM SURFACE OF HEAD OF RAIL | AVERAGE GRAIN SIZE OF PEARLITE BLOCK INSIDE HEAD OF RAIL * (μm) | AVERAGE HARDNESS INSIDE HEAD OF RAIL * (Hv, 98N) | ROLLING CONTACT FATIGUE TEST RESULT (FATIGUE LIMIT LOAD) (kN) |
|---|---|---|---|---|---|---|---|---|---|
| B26 | SAME AS A9 | 1200 | 7.0 | — | PEARLITE | PEARLITE | 215 | 320 | 90 (EMBRITTLEMENT OF PEARLITE STRUCTURE) |
| B27 | | 1100 | 4.0 | — | PEARLITE | PEARLITE | 110 | 320 | 90 (INCREASING OF PEARLITE BLOCK BOUNDARY) |
| A53 | | 1100 | 7.0 | — | PEARLITE | PEARLITE | 180 | 320 | 190 |
| A54 | | 1100 | 7.0 | 5.0 | PEARLITE | PEARLITE | 180 | 350 | 250 |
| B28 | SAME AS A24 | 950 | 8.0 | — | PEARLITE | PEARLITE | 90 | 330 | 65 (INCREASING OF PEARLITE BLOCK BOUNDARY) |

TABLE 3-2-continued

| SAMPLES No. | STEEL | REHEATING CONDITIONS: RE-HEATING TEMPERATURE (° C.) | REHEATING CONDITIONS: RETENTION TIME (min) | HEAT TREATMENT CONDITIONS: ACCELERATED COOLING RATE (° C./sec) | MICRO-STRUCTURE OF HEAD OF RAIL: DEPTH OF 2 mm FROM SURFACE OF HEAD OF RAIL | MICRO-STRUCTURE OF HEAD OF RAIL: DEPTH OF 25 mm FROM SURFACE OF HEAD OF RAIL | AVERAGE GRAIN SIZE OF PEARLITE BLOCK INSIDE HEAD OF RAIL * (μm) | AVERAGE HARDNESS INSIDE HEAD OF RAIL * (Hv, 98N) | ROLLING CONTACT FATIGUE TEST RESULT (FATIGUE LIMIT LOAD) (kN) |
|---|---|---|---|---|---|---|---|---|---|
| B29 | | 1080 | 15.0 | — | PEARLITE | PEARLITE | 230 | 330 | 85 (EMBRITTLEMENT OF PEARLITE STRUCTURE) |
| A55 | | 1080 | 8.0 | — | PEARLITE | PEARLITE | 165 | 330 | 185 |
| A56 | | 1080 | 8.0 | 9.0 | PEARLITE | PEARLITE | 165 | 415 | 260 |

* RANGE WITH DEPTH OF 20 mm TO 30 mm FROM SURFACE OF HEAD OF RAIL

The invention claimed is:

1. A rail having a chemical composition comprising, by mass %:

C: 0.75% to 1.20%;
Si: 0.10% to 2.00%;
Mn: 0.10% to 2.00%;
P: 0.0250% or less;
S: 0.0250% or less;
Cr: 0% to 2.00%;
Mo: 0% to 0.50%;
Co: 0% to 1.00%;
B: 0% to 0.0050%;
Cu: 0% to 1.00%;
Ni: 0% to 1.00%;
V: 0% to 0.50%;
Nb: 0% to 0.050%;
Ti: 0% to 0.0500%;
Mg: 0% to 0.0200%;
Ca: 0% to 0.0200%;
REM: 0% to 0.0500%;
Zr: 0% to 0.0200%;
N: 0% to 0.0200%; and
Al: 0% to 1.00%, the remainder being Fe and impurities, wherein the rail includes, a top head which is a flat region extending along a longitudinal direction of the rail and is located at a top of a head of the rail, a side head which is a flat region extending along the longitudinal direction of the rail and is located at a side of the head of the rail, a corner head which is a region including a rounded corner extending between the top head and the side head along the longitudinal direction of the rail, and an upper half of the side head, and a surface of the top head of the rail which is a region including a surface of the top head and a surface of the corner head, wherein in a range from the surface of the head of the rail to a depth of 30 mm, 95% or more of a structure is composed of a pearlite structure by area %, and in a range with a depth of 20 mm to 30 mm from the surface, an average grain size of a pearlite block in a transverse section is 120 μm to 200 μm.

2. The rail according to claim 1, wherein in a range with a depth of 20 mm to 30 mm from the surface of the head of the rail, average hardness is Hv 350 to Hv 460.

3. The rail according to claim 1, wherein the chemical composition further includes, by mass %, one or more kinds of Cr: 0.01% to 2.00%;
Mo: 0.01% to 0.50%;
Co: 0.01% to 1.00%;
B: 0.0001% to 0.0050%;
Cu: 0.01% to 1.00%;
Ni: 0.01% to 1.00%;
V: 0.005% to 0.50%;
Nb: 0.0010% to 0.050%;
Ti: 0.0030% to 0.0500%;
Mg: 0.0005% to 0.0200%;
Ca: 0.0005% to 0.0200%;
REM: 0.0005% to 0.0500%;
Zr: 0.0001% to 0.0200%;
N: 0.0060% to 0.0200%; and
Al: 0.0100% to 1.00%.

4. The rail according to claim 2, wherein the chemical composition further includes, by mass %, one or more kinds of Cr: 0.01% to 2.00%;
Mo: 0.01% to 0.50%;
Co: 0.01% to 1.00%;
B: 0.0001% to 0.0050%;
Cu: 0.01% to 1.00%;
Ni: 0.01% to 1.00%;
V: 0.005% to 0.50%;
Nb: 0.0010% to 0.050%;
Ti: 0.0030% to 0.0500%;
Mg: 0.0005% to 0.0200%;
Ca: 0.0005% to 0.0200%;
REM: 0.0005% to 0.0500%;
Zr: 0.0001% to 0.0200%;
N: 0.0060% to 0.0200%; and
Al: 0.0100% to 1.00%.

* * * * *